US008978392B2

(12) United States Patent
Blackway et al.

(10) Patent No.: US 8,978,392 B2
(45) Date of Patent: *Mar. 17, 2015

(54) THERMOELECTRICALLY AIR CONDITIONED TRANSIT CASE

(71) Applicant: EIC Solutions, Inc., Warminster, PA (US)

(72) Inventors: Bruce W. Blackway, Pipersville, PA (US); Adelbert M. Gillen, Lake Worth, FL (US)

(73) Assignee: EIC Solutions, Inc., Warminster, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/947,486

(22) Filed: Jul. 22, 2013

(65) Prior Publication Data

US 2014/0020406 A1 Jan. 23, 2014

Related U.S. Application Data

(63) Continuation of application No. 11/997,362, filed as application No. PCT/US2005/043702 on Dec. 2, 2005, now Pat. No. 8,490,413.

(60) Provisional application No. 60/705,680, filed on Aug. 4, 2005, provisional application No. 60/727,736, filed on Oct. 18, 2005.

(51) Int. Cl.
*F25B 21/02* (2006.01)

(52) U.S. Cl.
CPC ..... *F25B 21/02* (2013.01); *F25B 2321/023* (2013.01); *F25B 2321/0251* (2013.01);
(Continued)

(58) Field of Classification Search
CPC ..... F25B 21/02; H01L 35/30; F25D 2400/12; F25D 11/00; F25D 31/005; G06F 1/20
USPC ..... 62/3.62, 3.2, 3.3, 259.2, 457.9
See application file for complete search history.

(56) References Cited

U.S. PATENT DOCUMENTS 3,194,023 A * 7/1965 Sudmeier ..... 62/3.62
3,823,567 A * 7/1974 Corini ..... 62/3.6
(Continued)

FOREIGN PATENT DOCUMENTS

FR 2435680 A1 4/1980
JP 2000329440 A 11/2000

OTHER PUBLICATIONS

Supplementary Partial European Search Report dated May 27, 2014 in corresponding European Patent Application No. EP 05852815.
(Continued)

*Primary Examiner* — Melvin Jones
(74) *Attorney, Agent, or Firm* — Pepper Hamilton LLP

(57) ABSTRACT

Systems and methods for cooling the contents within a portable case, such as a transit case, using a thermoelectric air conditioner. Thermoelectric air conditioners are used with, and mounted on or in, a transit case for maintaining a desired air temperature within the transit case. In one embodiment, the thermoelectric air conditioner can be incorporated, concealed within the housing and/or cover of the transit case. In this embodiment, the thermoelectric air conditioner is protected by the design of the case, the mounting arrangement, the shock-mounted frame, etc. Alternatively, the thermoelectric air conditioner is mounted partially internal and partially external to the transit case. In another embodiment, the thermoelectric air conditioner is mounted external to the transit case.

19 Claims, 32 Drawing Sheets

(52) U.S. Cl.
CPC . *F25D2317/0655* (2013.01); *F25D 2317/0665* (2013.01); *F25D 2400/12* (2013.01); *F25D 2700/12* (2013.01)
USPC ..... 62/3.62; 62/457.9

(56) References Cited

U.S. PATENT DOCUMENTS

| | | | | |
|---|---|---|---|---|
| 4,364,234 | A | 12/1982 | Reed | |
| 4,759,190 | A | 7/1988 | Trachtenberg et al. | |
| 4,823,554 | A * | 4/1989 | Trachtenberg et al. | 62/3.62 |
| 5,301,508 | A | 4/1994 | Kahl et al. | |
| 6,345,507 | B1 | 2/2002 | Gillen | |
| 6,499,306 | B2 | 12/2002 | Gillen | |
| 6,889,513 | B1 | 5/2005 | Clark | |
| 8,490,413 | B2 * | 7/2013 | Blackway et al. | 62/3.62 |

OTHER PUBLICATIONS

European Search Report dated May 28, 2014 in corresponding European Patent Application No. EP 14151489.
International Search Report dated Oct. 29, 2007 in corresponding International Patent Application No. PCT/US2005/043702.
Office Action dated Dec. 15, 2010 in corresponding Israeli Patent Application No. 189148.

* cited by examiner

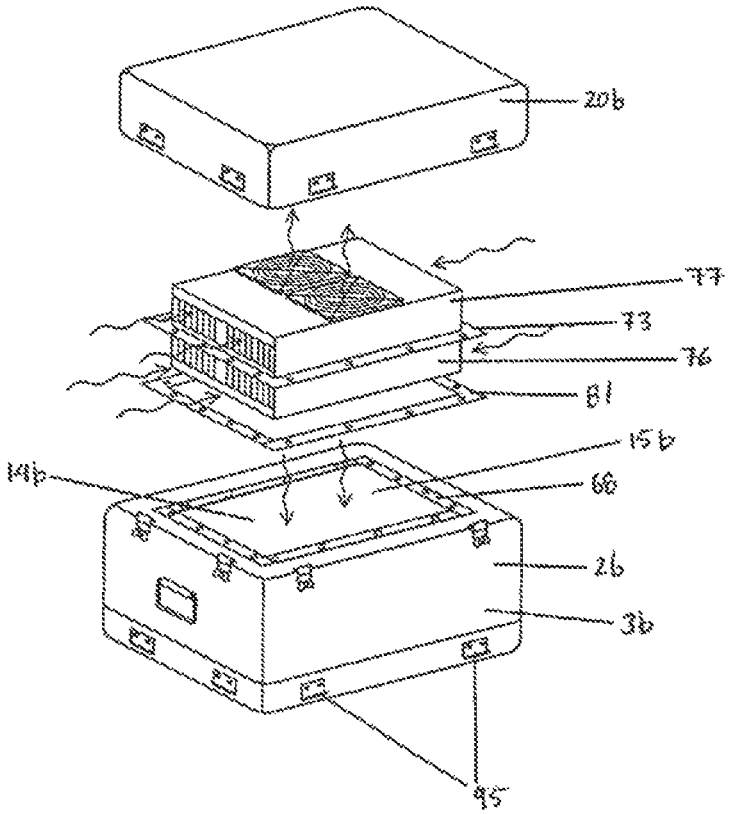
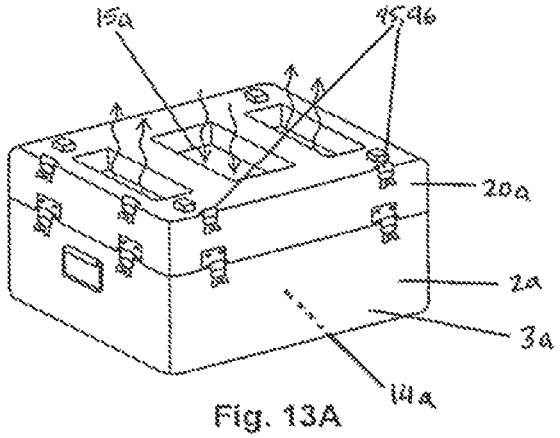
Fig. 13A

MIL-STD-1472 Lift Limitations (ground/floor to height in pounds )

| | High Lift (to 60' ) 1 person | Low Lift (to 36' ) 1 person | High Lift (to 60' ) 2 person | Low Lift (to 36' ) 2 person | High Lift (to 60' ) 3 person | Low Lift (to 36' ) 3 person | High Lift (to 60' ) 4 person | Low Lift (to 36' ) 4 person | High Lift (to 60' ) 5 person | Low Lift (to 36' ) 5 person | High Lift (to 60' ) 6 person | Low Lift (to 36' ) 6 person | High Lift (to 60' ) 7 person | Low Lift (to 36' ) 7 person | High Lift (to 60' ) 8 person | Low Lift (to 36' ) 8 person | High Lift (to 60' ) 9 person | Low Lift (to 36' ) 9 person | High Lift (to 60' ) 10 person | Low Lift (to 36' ) 10 person |
|---|---|---|---|---|---|---|---|---|---|---|---|---|---|---|---|---|---|---|---|---|
| Male & Female | 37 | 44 | 74 | 88 | 102 | 121 | 130 | 154 | 158 | | 186 | 220 | 214 | 253 | 242 | 286 | 270 | 319 | 298 | 352 |
| Male Only | 56 | 87 | 112 | 174 | 154 | 239 | 56 | 305 | 238 | 370 | 280 | 435 | 322 | 500 | 364 | 565 | 406 | 630 | 448 | |
| M&F LO | | 44 | | 88 | | 121 | | 154 | | 187 | | 220 | | 253 | | 56 | | 319 | | |
| M&F HI | 37 | | 74 | | 102 | | 56 | | 158 | | 186 | | 214 | | 242 | | 270 | | 298 | |

| | High Lift (to 60' ) 11 person | Low Lift (to 36' ) 11 person | High Lift (to 60' ) 13 person | Low Lift (to 36' ) 13 person |
|---|---|---|---|---|
| Male & Female | 326 | 385 | 460 | 372 |
| Male Only | 470 | | | |
| M&F LO | | | | |
| M&F HI | 326 | | | |

For mixed soldier teams female or male, lifting object floor to 60" height, maximum pounds are:

| 1 person | 2 person | 3 person | 4 person | 5 person | 6 person | 7 person | 8 person | 9 person | 10 person | 11 person | 12 person | 13 person | 14 person | 15 person | 16 person | 17 person | 18 person | 19 person | 20 person |
|---|---|---|---|---|---|---|---|---|---|---|---|---|---|---|---|---|---|---|---|
| 37 | 74 | 102 | 130 | 158 | 186 | 214 | 242 | 270 | 298 | 326 | 354 | 332 | 410 | 438 | 466 | 494 | 522 | 550 | 578 |

For mixed soldier teams female or male, lifting object floor to 36" height, maximum pounds are:

| 1 person | 2 person | 3 person | 4 person | 5 person | 6 person | 7 person | 8 person | 9 person | 10 person | 11 person | 12 person | 13 person |
|---|---|---|---|---|---|---|---|---|---|---|---|---|
| 44 | 88 | 121 | 154 | 187 | 220 | 253 | 286 | 319 | 352 | 385 | 418 | 451 |

| | High Lift (to 60' ) 1 person | Low Lift (to 36' ) 1 person | High Lift (to 60' ) 2 person | Low Lift (to 36' ) 2 person | High Lift (to 60' ) 3 person | Low Lift (to 36' ) 3 person | High Lift (to 60' ) 4 person | Low Lift (to 36' ) 4 person | High Lift (to 60' ) 5 person | Low Lift (to 36' ) 5 person | High Lift (to 60' ) 6 person | Low Lift (to 36' ) 6 person | High Lift (to 60' ) 7 person | Low Lift (to 36' ) 7 person |
|---|---|---|---|---|---|---|---|---|---|---|---|---|---|---|
| Male & Female | 37 | 44 | 74 | 88 | 102 | 121 | 130 | 154 | 157 | 187 | 185 | 220 | 213 | 253 |
| Male Only | 56 | 87 | 112 | 174 | 154 | 239 | 56 | 305 | 238 | 370 | 280 | 435 | 322 | 500 |

FIG. 14

THERMOELECTRICALLY AIR CONDITIONED TRANSIT CASE

CROSS-REFERENCE TO RELATED APPLICATIONS

This application is a continuation of U.S. Ser. No. 11/997,362, filed Jul. 8, 2008, which is the National Stage of International Application No. PCT/US2005/043702, filed Dec. 2, 2005, which claims the benefit of U.S. Provisional Application No. 60/705,680, filed Aug. 4, 2005, and U.S. Provisional Application No. 60/727,736, filed Oct. 18, 2005, each of which is incorporated herein by reference in its entirety.

FIELD OF THE INVENTION

This invention relates generally to thermoelectrically air conditioned cases. More specifically, the present invention relates to, thermoelectric air conditioners for use with, and mounted on or in, a transit case for maintaining a desired air temperature within the transit case to protect temperature sensitive equipment, such as electrical and electronic devices.

BACKGROUND

Transit cases exist to house and protect equipment during shipment from one location to another location and during temporary use of the equipment at remote locations. These transit cases are also sometimes referred to by other and different names, such as: Transit Case; Dry Case; Rotomold Case; Rotomolded Case; Rotationally Molded Case; Injection Molded Case; Utility Case; Transport Case; Transportation Case; Travel Case; Rack Case; Rackmount Case; Shock-Rack Case; Blow Molded Case; Vacuum Molded Case; Shipping Case; Storage Case; Military Case; Waterproof Case; Engineered Case; Computer Case; and ATA (Airline Travel) Case.

These cases are typically produced of the following materials: Rotomolded PE (polyethylene); Injection molded ABS; Fiberglass (FRP); Thermo Stamped Composite (TSC), which is glass-reinforced polypropylene; Aluminum; Steel; Stainless Steel, and other materials.

These cases are manufactured by a number of different firms. A few of the manufacturers in this industry include: Hardigg Industries, Inc., South Deerfield, Mass. (see www.hardigg.com); ECS Composites Inc., Grants Pass, Oreg. (see www.ecscase.com); SKB Corp., Orange, Calif. (see www.skbcases.com); Zero Manufacturing Inc., North Salt Lake, Utah (see www.zerocases.com); Pelican Products, Inc., Torrance, Calif. (see www.pelican.com); Quantum Scientific, Ontario, Canada (see www.cyber-case.com); Ameripack Corporation, Robbinsville, N.J. (see www.ameripack-.com).

These cases are designed to house and protect equipment. The equipment can include items such as electronics, instrumentation, computers, telecommunications gear, and the like. Protection is provided during transit, storage and operation of the equipment. The cases are typically designed to protect the equipment contained within the case from one or more of the following elements (list is not all-inclusive): heat; dirt; dust; debris; vandalism; shock; vibration; dropping; moisture; rain; snow; sleet; hail; ice; cold; and the like.

Depending on the style and construction of the case, many cases can handle one or more of the above needs. But, most, if not all, have difficulty handling heating and cooling requirements of the internal equipment during transportation, storage, and operation. Since most cases are airtight (or substantially airtight), if electronics are contained within the case, there is often heat build-up. Also, if the case is outdoors, and especially if the case is outdoors and in direct sunlight, heat build-up can be excessive, causing damage or failure to the equipment within the case.

Conventional solutions to the above heat problem include fans, holes, openings, louvers, etc. in or on the case. These solutions to the heat problem, however, then cause the case to give up its ability to protect against other elements, such as dirt, dust, other contaminants, etc. In addition, these solutions can not drive the temperature within the case below ambient.

Another conventional solution is to install a heat exchanger in or on the case. But conventional heat exchangers can not drive the temperature within the case below ambient.

If the goal is to drive the temperature within the case below the ambient temperature, this can best be done utilizing an air conditioner. Most air conditioners are the traditional compressor-based type. Since traditional compressor-based air conditioners have a compressor, they are somewhat larger in size and heavier in weight than desired. In addition, traditional compressor-based type air conditioners must remain in one orientation (typically vertical). Also, compressor-based air conditioners include additional components, such as refrigerants and filters, and require regular maintenance. Further, most compressor-based coolers are AC-powered (120 VAC or 240 VAC), are not easily or readily portable, and have other disadvantages when considered for use with a transit case.

SUMMARY

The present invention is directed to systems and methods for maintaining a desired air temperature within a portable case, such as a transit case, using a thermoelectric heat exchanger.

According to one preferred embodiment of the present invention, a thermoelectric air conditioner is mounted on or in a transit case for cooling the contents (typically sensitive equipment or systems) within the transit case.

According to another aspect of the invention, a lightweight and compact thermoelectric air conditioner is used. A thermoelectric solid state air conditioner provides advantages over conventional compressor-type air conditioners in that a thermoelectric air conditioner has no compressor, refrigerants or filters and provides reliable, virtually maintenance-free cooling in both indoor and outdoor applications.

According to another aspect of the invention, the thermoelectric air conditioner is incorporated into the case, concealed within the housing and/or cover of the transit case. In this embodiment, the thermoelectric air conditioner is protected by the design of the case, the mounting arrangement, the shock-mounted frame, etc.

According to another aspect of the invention, the thermoelectric air conditioner is mounted partially internal and partially external to the transit case.

According to another aspect of the invention, the thermoelectric air conditioner is mounted to the top and/or side of the transit case.

According to another aspect of the invention, more than one thermoelectric air conditioner are installed in or on the case.

According to another aspect of the invention, insulation is installed within the transit case. Insulation reduces thermal heat transfer between the interior and the exterior of the case. The addition of insulation can also reduce solar loading on the case and heat penetration into the case, providing for greater reduction of internal temperatures.

According to another aspect of the invention, an adapter plate can be used to "close the gap" between the edges of the thermoelectric air conditioner mounting flange and the internal sides of the transit case. The adapter plate preferably includes a seal or gasket that forms a boundary between the thermoelectric air conditioner and the case. This further enhances the ability of the transit case to maintain, as close as possible, an airtight status and seal out moisture, dirt, sand, etc. thus substantially preventing these contaminants from entering the interior of the case.

According to another aspect of the invention, an extender piece or extension frame can be used to flush mount the thermoelectric air conditioner to the case when, for example, the entire internal cavity of the case is needed to house the equipment.

According to another aspect of the invention, the thermoelectric air conditioner is removably mounted on the case such that it can be mounted on the case during operation or stowed away in the case during transit.

According to another aspect of the invention, the thermoelectric air conditioner is housed within a secondary case and the equipment is housed within a primary case. During operation, the covers of the primary and secondary cases are removed such that the primary and secondary cases can be connected and can be in thermal communication. During transit, the primary and secondary cases can be disconnected and the covers can be replaced such that the equipment and thermoelectric air conditioners are protected. In one embodiment, the primary case and the secondary case are mounted end to end, and in another embodiment the primary case and the secondary case are mounted one on top of the other.

According to another aspect of the invention, a rack mounted frame can be installed in the cavity of the case. In this embodiment, the equipment and thermoelectric air conditioners can be mounted on the rack mount frame to balance the load on the frame and make it easier to handle the case. In addition, the rack mount frame can be supported by elastomer shock mounts attached to the walls of the case to protect the equipment mounted in the case and help absorb shock, vibration, noise, etc.

According to another aspect of the invention, the thermoelectrically air conditioned transit case is designed for easy handling. In one embodiment, the case is fitted with wheels so that the case may be easily moved around. In another embodiment, the thermoelectrically air conditioned transit case is fitted with handles that are located in grooves or recesses in the housing and are positioned within the groove or recess when not in use and are accessible or capable of moving out of the groove or recess when in use. In another embodiment, the thermoelectrically air conditioned transit cases may be stacked end-to-end and/or one on top of another. In this embodiment, the housing of the case may include a shoulder and slot design wherein the shoulder of one case would be received within a corresponding slot of an adjoining case.

Additional features and advantages of the invention will be made apparent from the following detailed description of illustrative embodiments that proceeds with reference to the accompanying drawings.

BRIEF DESCRIPTION OF THE DRAWINGS

The invention is best understood from the following detailed description when read in connection with the accompanying drawing. It is emphasized that, according to common practice, various features of the drawings are not to scale. On the contrary, the dimensions of various features are arbitrarily expanded or reduced for clarity. Included in the drawings are the following Figures that show various exemplary embodiments and various features of the present invention:

FIGS. 13A and 13B is an exploded perspective view of another exemplary embodiment of a thermoelectric air conditioned transit case having two cases mounted to one another one, with the thermoelectric air conditioner mounted in a secondary case and the equipment to be protected in the primary case;

FIG. 14 is a chart illustrating exemplary design or performance standards for an exemplary transit case;

DETAILED DESCRIPTION OF ILLUSTRATIVE EMBODIMENTS

Figure 1:
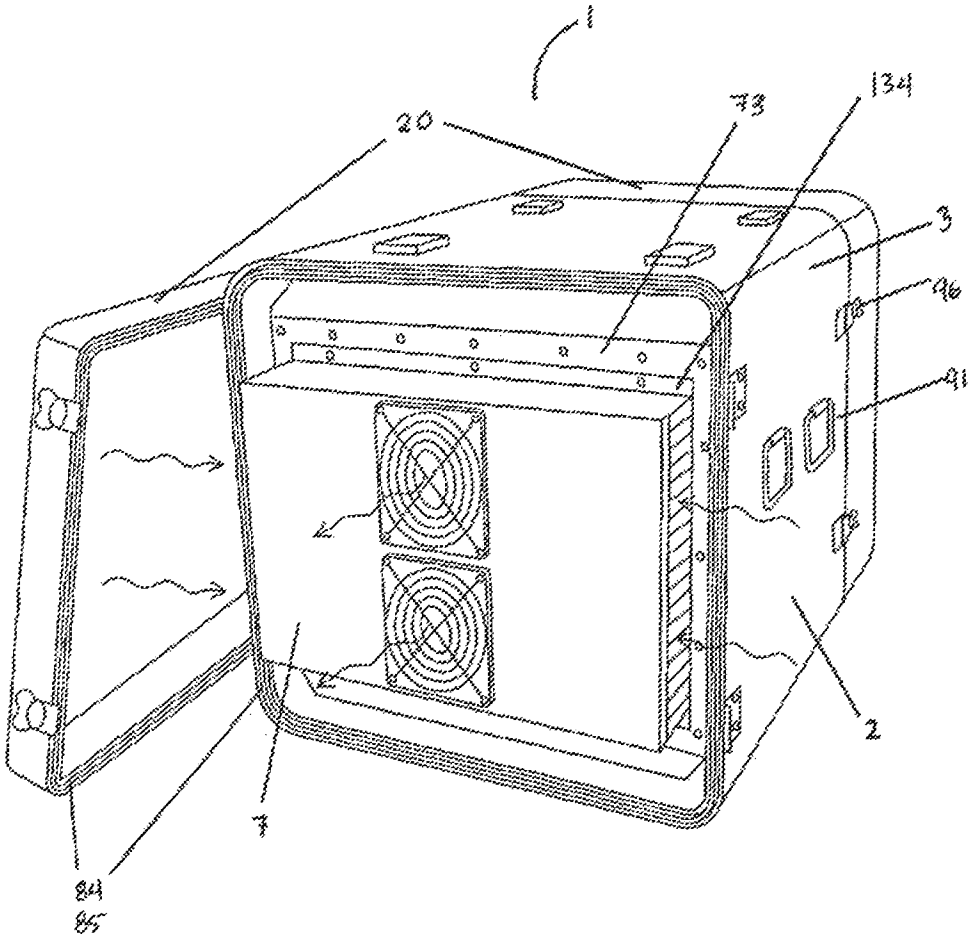
FIG. 1 shows a perspective view of an exemplary thermoelectrically air conditioned transit case having a thermoelectric air conditioner vertically mounted internal to the transit case with the transit case front cover removed for clarity.
Figure 2:
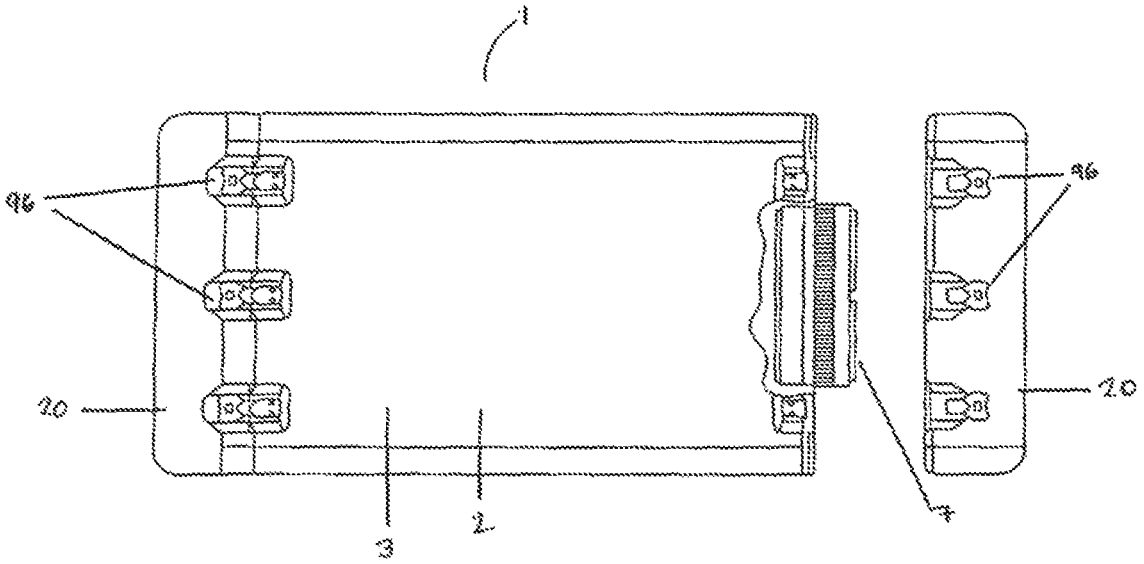
FIG. 2 is a side view of the thermoelectrically air conditioned transit case of FIG. 1.
Figure 3:
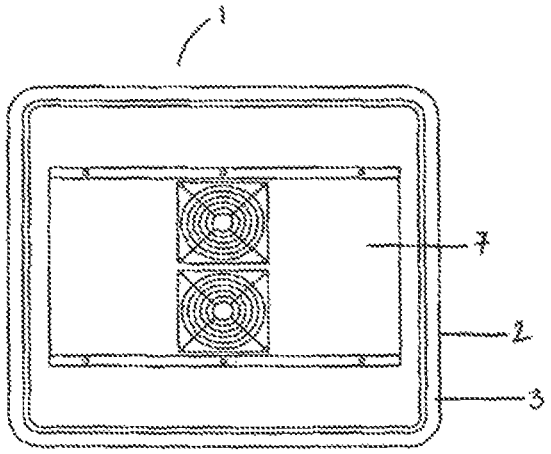
FIG. 3 is an end view of the thermoelectrically air conditioned transit case of FIG. 2.

The present invention is directed to systems and methods for maintaining a desired temperature within a portable case 2, such as a transit case, using a thermoelectric heat exchanger 7. In a preferred embodiment, one or more thermoelectric air conditioners 7 is mounted on or in a transit case 2 for cooling the contents (typically sensitive equipment and/or systems) within the transit case 2. A properly sized thermoelectric air conditioner 7 is capable of reducing the temperature inside the case 2 below the ambient temperature outside the case 2, thus providing a temperature inside the case 2 that is within the customer's goals and ensuring safe storage and/or operation of equipment.

At the same time, a thermoelectrically air conditioned transit case 1 preferably maintains most, if not all, of the benefits of using a transit case 2 (i.e., light-weight, mobile, stackable, durable, protective, etc.) to transport equipment from one location to another location. Also, a thermoelectric air conditioner 7, as a solid-state device to control temperature, provides other benefits, including: highly reliable; virtually maintenance-free; no air exchange between outside and inside; suitable for use in operating environment up to about 140.degree. F.; indoor or outdoor use; vertical or horizontal installation; compact; light-weight; wide capacity range (e.g., about 200-2500 BTU range); cooling and/or heating models; no filters to change or clean; no compressor; no condenser; no refrigerants; no chemicals; no copper tubing; no moving components (other than fans); ideal for cooling electronics; no performance loss when input voltage drops or there are "brown-outs"; units are manufactured to UL standards; thermoelectric coolers can be conveniently powered from AC and/or DC power sources; and the like.

The thermoelectrically air conditioned transit case 1 includes several exemplary embodiments. FIGS. 1-6 show exemplary internal embodiments of thermoelectrically air conditioned transit cases 1 having the thermoelectric air conditioner 7 located internally within the transit case 2. In the exemplary internal embodiments shown in FIGS. 1-6, the thermoelectric air conditioner 7 is preferably mounted completely within an outer boundary (walls, covers, lids, etc.) of the case 2 and is completely protected by the transit case 2.

In exemplary external embodiments shown in FIGS. 7-10, a thermoelectric air conditioner 7 is located externally on the transit case 2. FIG. 7A shows an externally mounted thermoelectric air conditioner 7 wherein the thermoelectric air conditioner 7 is through-mounted on the transit case 2. In the through-mounted embodiment, the thermoelectric air conditioner is located partially internal and partially external to the transit case 2 (i.e., partially inside and partially outside the outer boundary of the transit case).

Figure 7A:
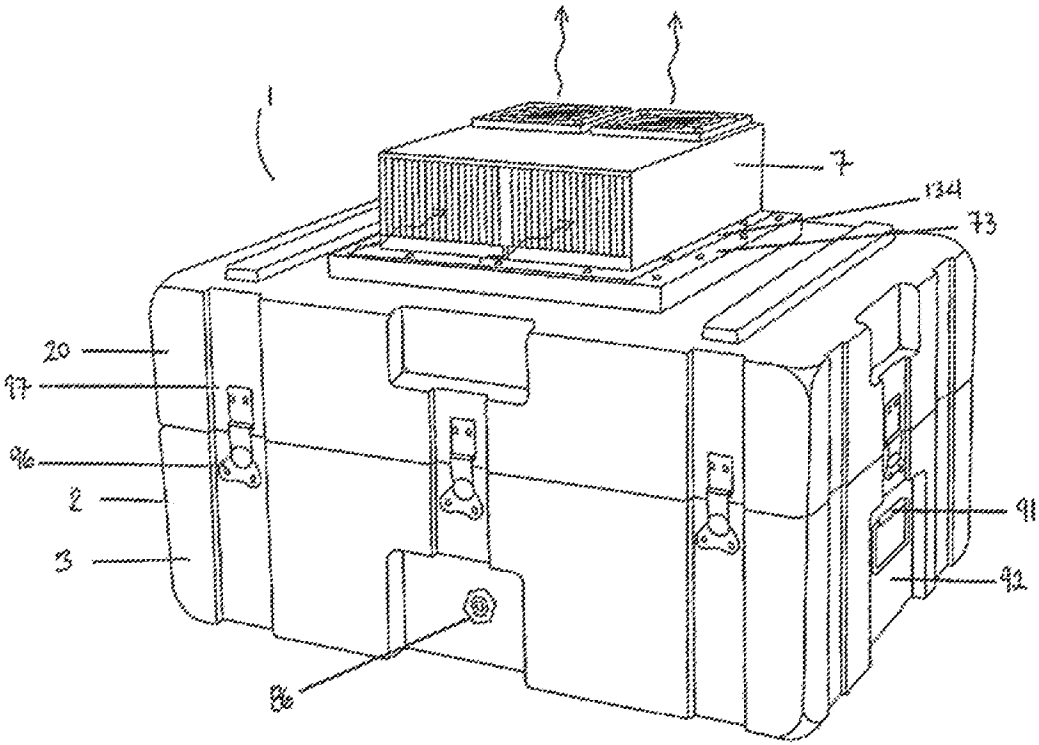
FIG. 7A is a perspective view of another exemplary embodiment of a thermoelectrically air conditioned transit case having a thermoelectric air conditioner through-mounted with at least a portion of the thermoelectric air conditioner being internal to the transit case.
Figure 7B:
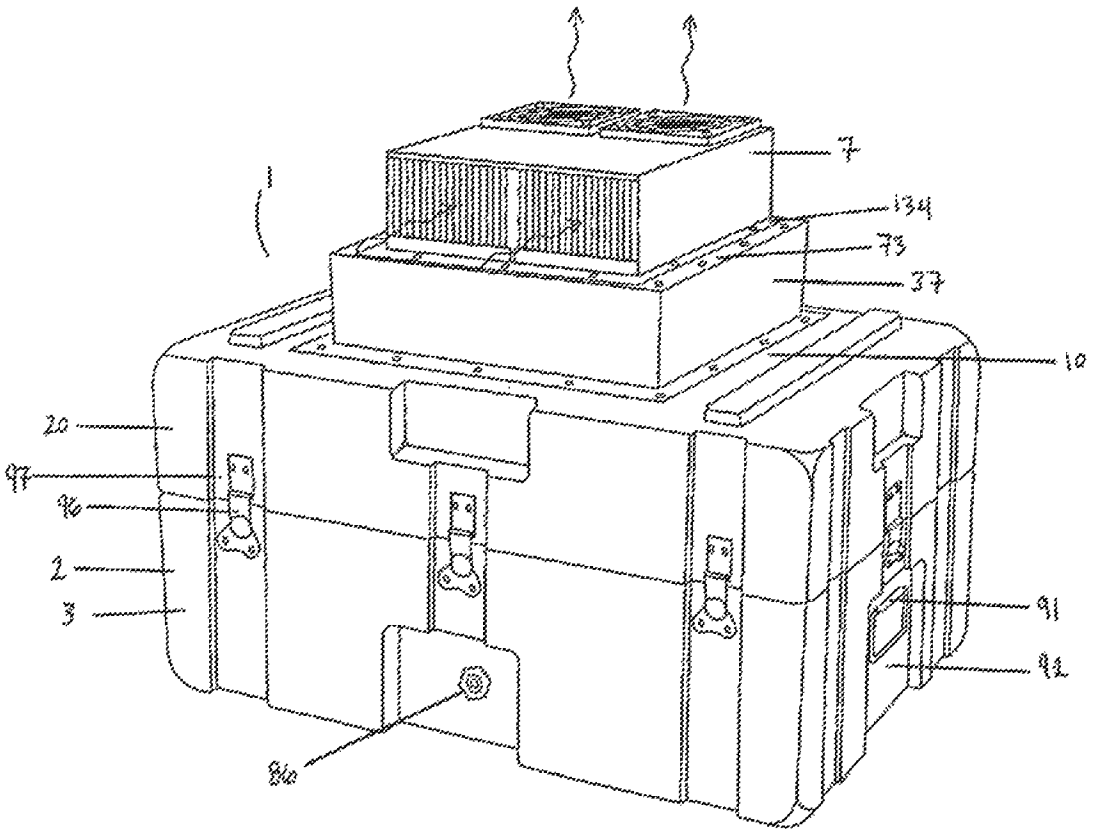
FIG. 7B is a perspective view of the embodiment of FIG. 7A with the thermoelectric air conditioner flush-mounted to the case.

In the exemplary external embodiment shown in FIG. 7B, the externally mounted thermoelectric air conditioner 7 is flush-mounted outside the outer boundary (walls, covers, lids, etc.) and does not penetrate into the interior cavity 14 of the case 2. An extension frame 37 is used to flush-mount the thermoelectric air conditioner 7 to the case 2 and the extension frame 37 extends between the mounting flange 73 of the thermoelectric air conditioner's mounting frame 72 and the exterior surface of the case 2 around the periphery of the opening 15 in the case 2. This embodiment can be used where there is little or no room unoccupied by the equipment 5 within the internal cavity 14. The cold side 76 of the thermoelectric air conditioner 7 is in thermal communication with the internal cavity 14 of the transit case 2 through an opening and/or passageway 15 in the wall 10 of the case 2. The external, flush-mounted thermoelectric air conditioner 7 can be protected by a separate lid or cover 25 (see, for example, FIG. 11).

Figure 8:
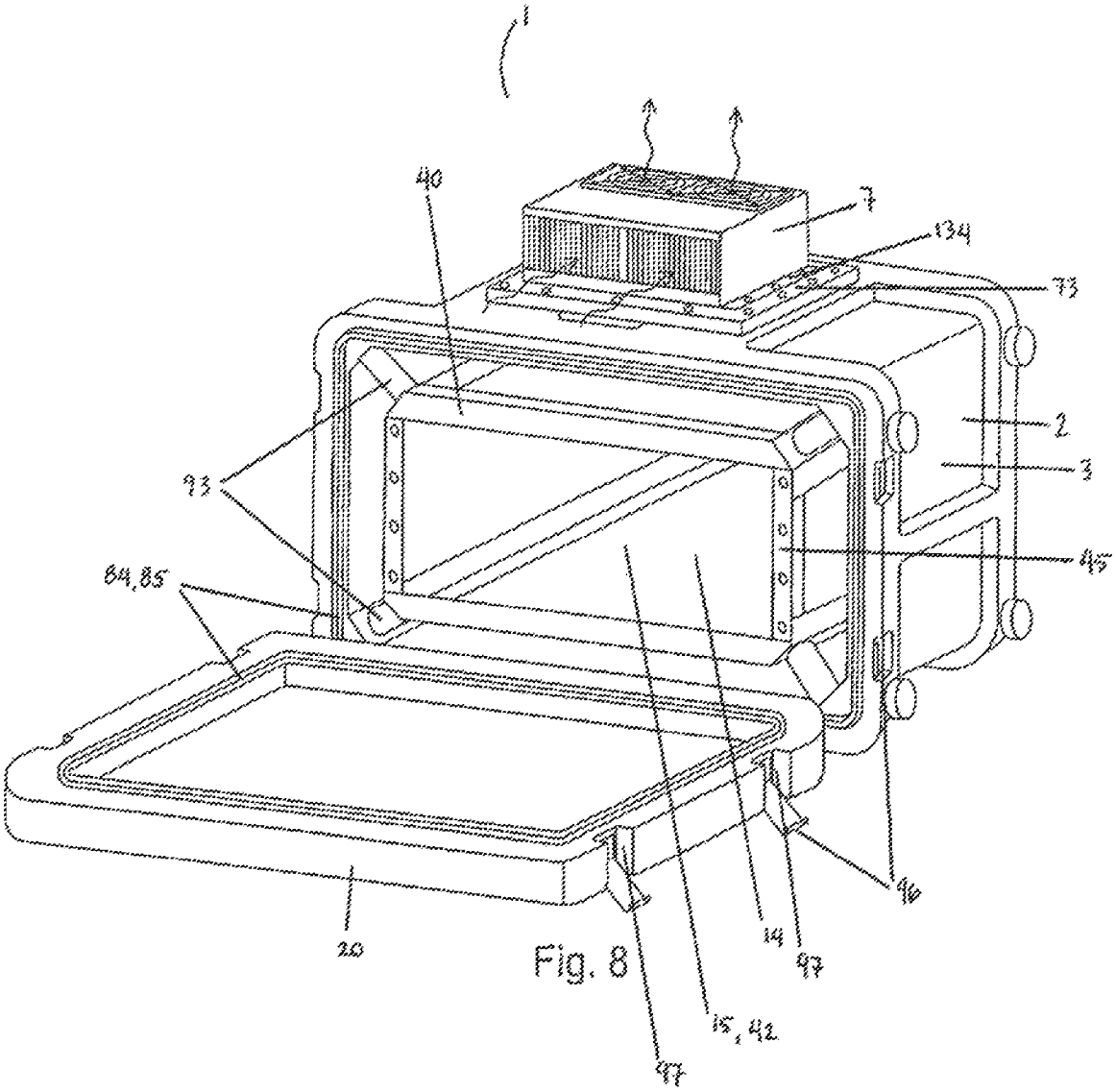
FIG. 8 is a perspective view of another exemplary embodiment of a thermoelectrically air conditioned transit case having an external, horizontal, through-mounted thermoelectric air conditioner.

FIG. 8 shows another embodiment of a transit case 2 having end covers 20 and the thermoelectric air conditioner 7 is externally mounted to the top of the case 2. This embodiment may include a through-mounted and/or a flush-mounted thermoelectric air conditioner 7 and allows for easy access to the internal cavity 14 and the equipment 5 stored therein from one or either end of the case 2. Preferably, the external, top mounted thermoelectric air conditioner 7 is removable or protected by a separate lid or cover 25 during transit.

Figure 9A:
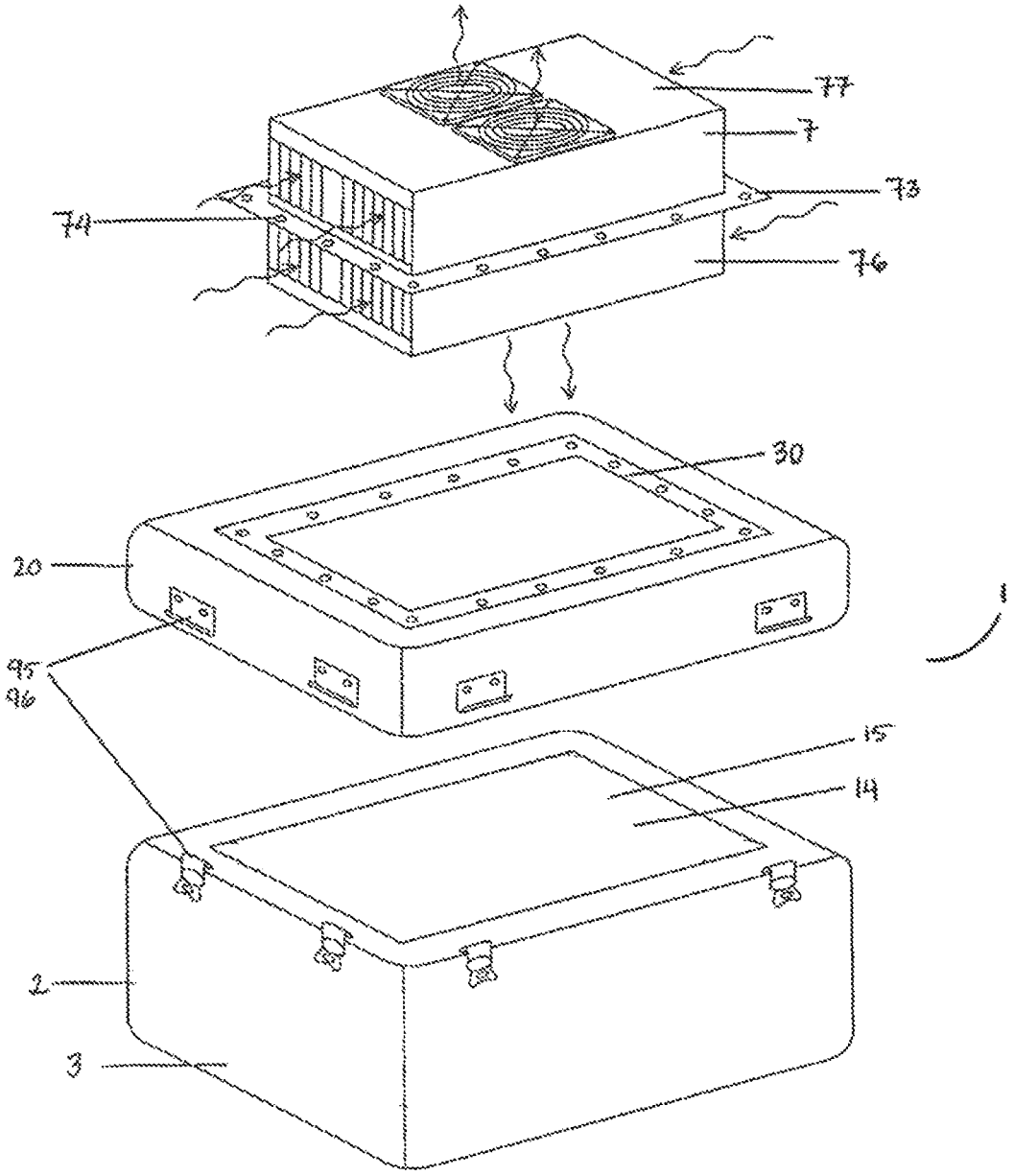
FIG. 9A is an exploded view of an exemplary thermoelectrically air conditioned transit case similar to the embodiment of FIG. 7A, wherein the thermoelectric air conditioner is removably mounted.
Figure 9B:
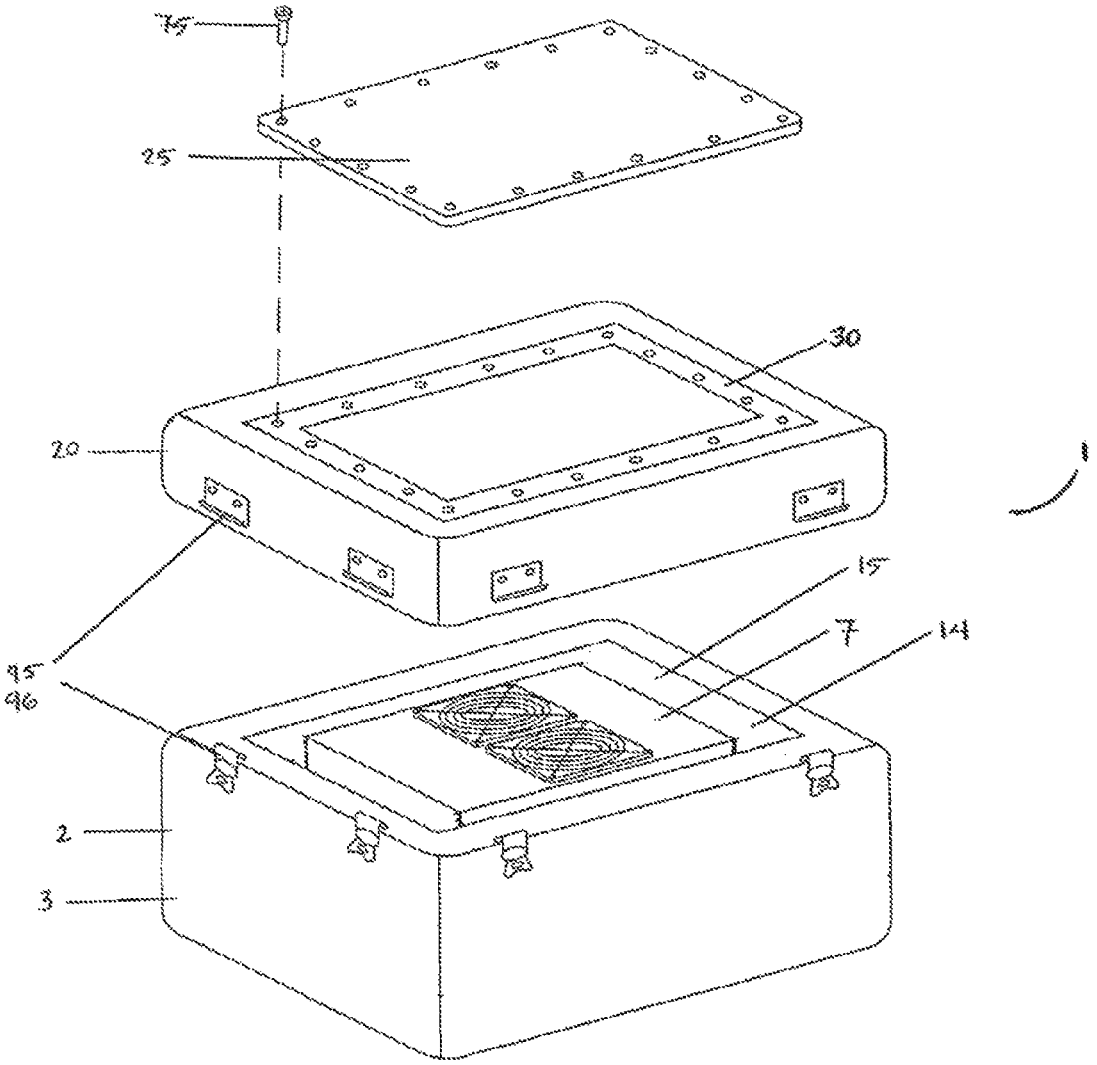
FIG. 9B shows the thermoelectric air conditioner of FIG. 9A removed and stowed in the transit case.

The embodiment of FIGS. 9A and 9B show an externally mounted thermoelectric air conditioner 7 that is removably-mounted to the case 2. As shown, the thermoelectric air conditioner 7 can be removably-mounted directly to the case 2, to a cover or lid 20 of the case 2. Alternatively, the thermoelectric air conditioner 7 can be removably-mounted to a separate, secondary cover or lid 24 (see FIG. 10C). As shown in FIG. 9A, the thermoelectric air conditioner 7 is installed in or on the transit case 2 to control the temperature of the internal cavity 14 of the case 2 during operation. During transit, the thermoelectric air conditioner 7 can be removed and stored within the transit case 2, as shown in FIG. 9B.

Figure 10A:
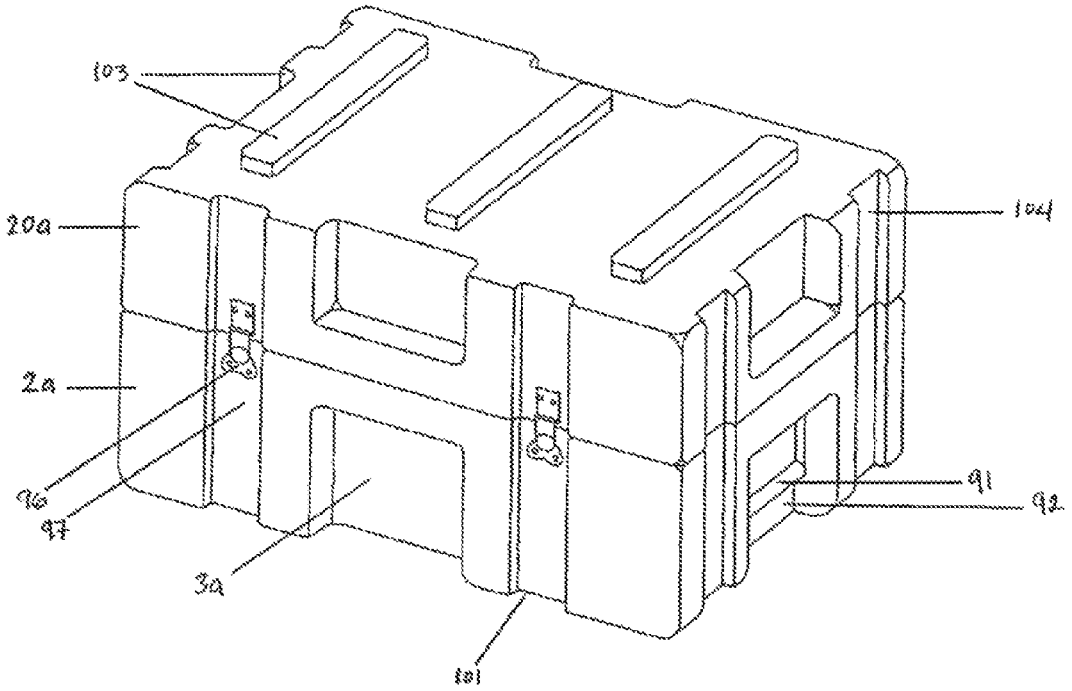
FIGS. 10A-10D show features of another exemplary thermoelectric air conditioned transit case.
Figure 10B:
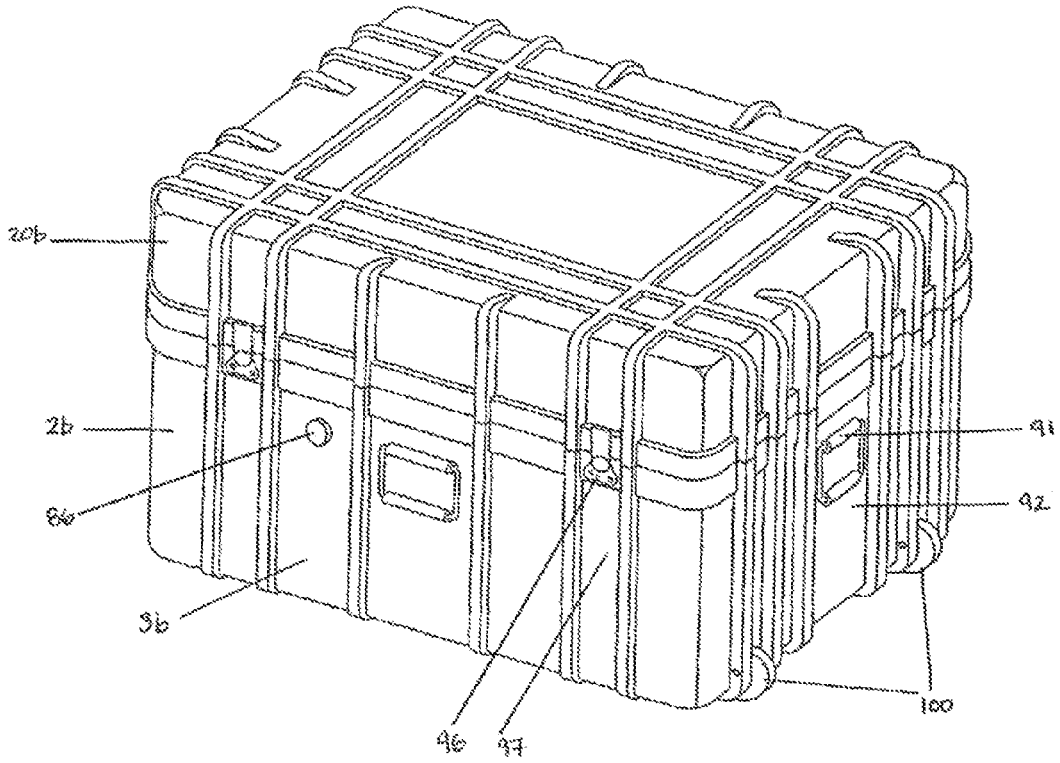
Figure 10C:
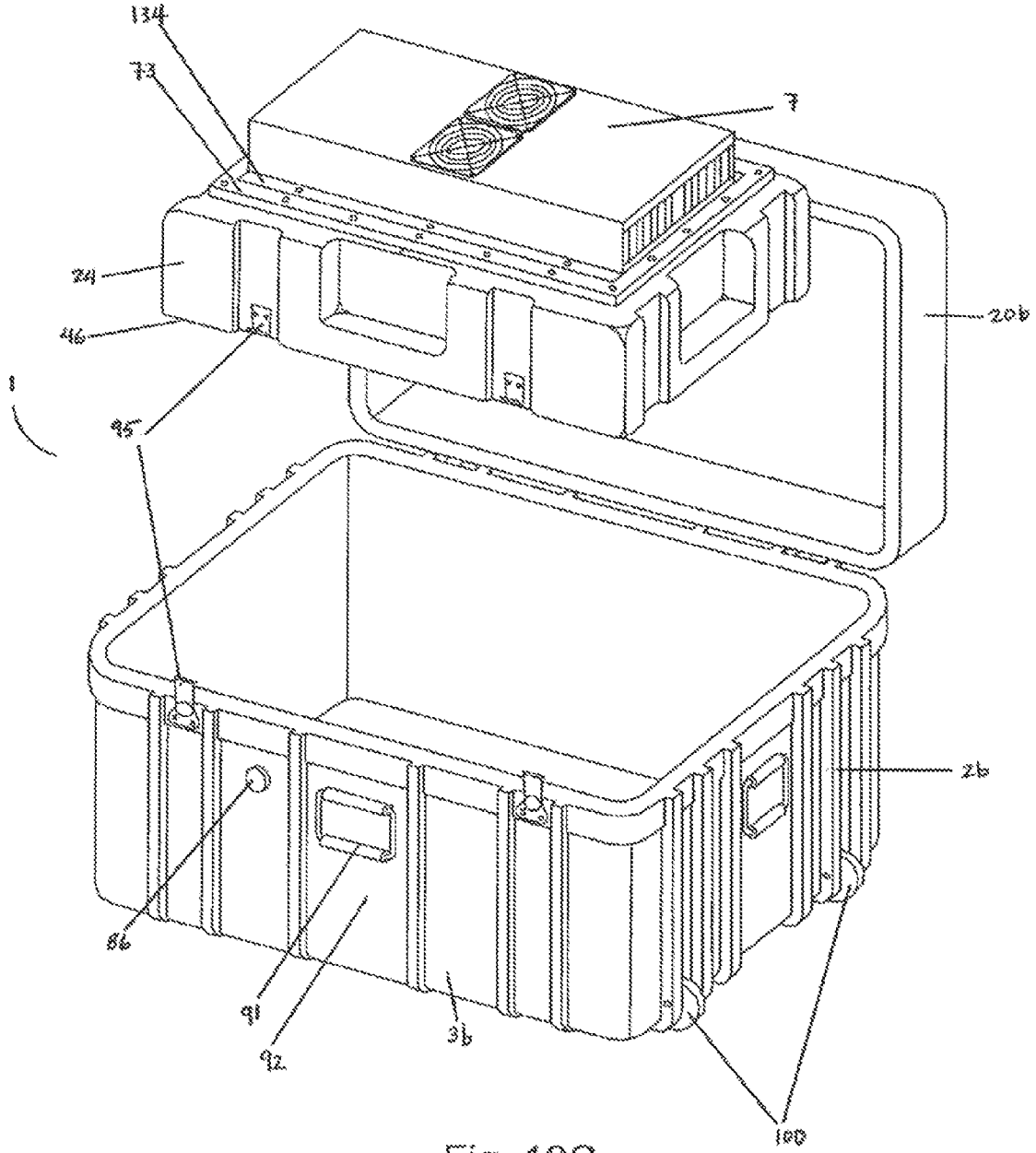
Figure 10D:
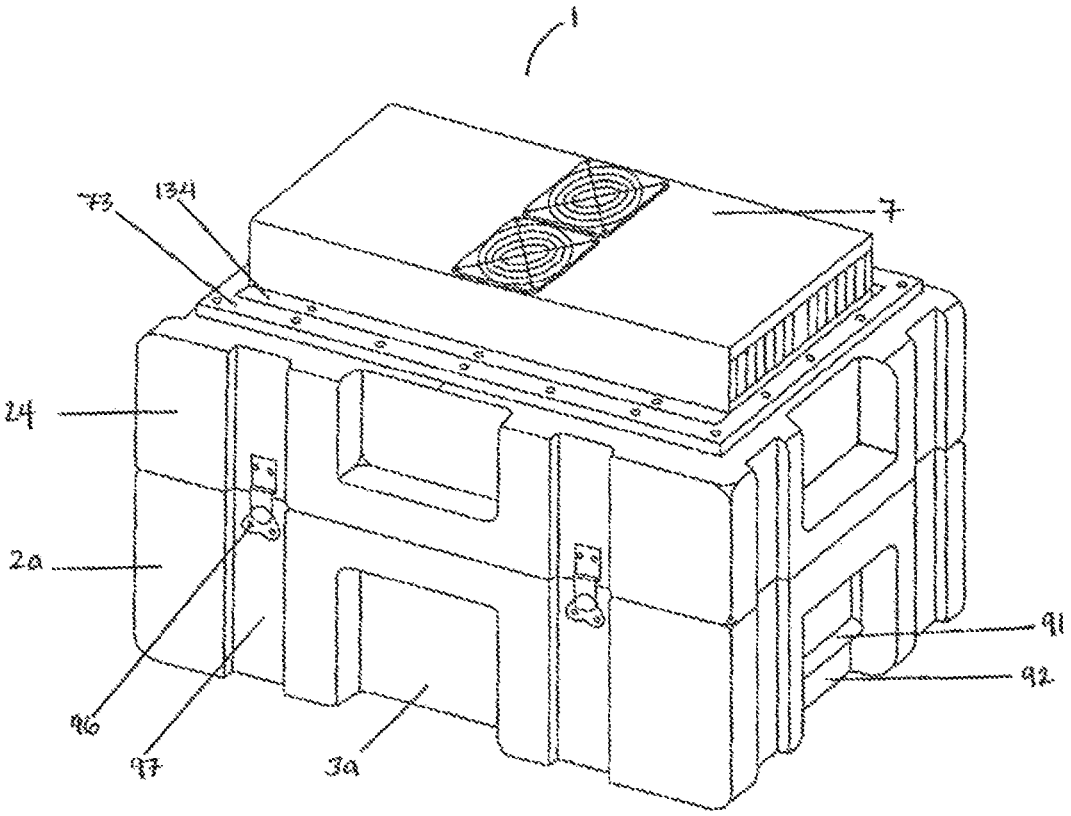

In another embodiment shown in FIGS. 10A-10D, the removable thermoelectric air conditioner 7 can be pre-mounted to a separate, secondary cover/lid 24 that can be stored in a separate, secondary case 2*b* during transit, and placed on the primary case 2*a* to be cooled after transit. FIG. 10A shows the primary case 2*a* (i.e., the case housing the equipment 5 to be cooled) ready for transit. FIG. 10B shows the secondary case 2*b* (i.e., the case housing the thermoelectric air conditioner 7 mounted to a secondary cover 24) ready for transit. FIG. 10C shows the secondary case 2*b* with its cover 20*b* open and the thermoelectric air conditioner 7 mounted to secondary cover 24 being removed. Although not shown, it is also contemplated that a complete case 2*a* (including the entire housing 3*a*, cover 20*a*, and mounted thermoelectric air conditioner 7) could be stowed within another, larger case 2*b* for transit. FIG. 10D shows the primary case 2*a* on-site, its transit cover 20*a* removed and the combination thermoelectric air conditioner 7 and secondary cover 24 installed/mounted to the lower portion of the primary case 2*a*. The thermoelectrically air conditioned transit case 1 can now be placed in operation. The pre-mounting of the thermoelectric air conditioner 7 to a secondary cover 24 that is the same as the cover 20*a* used during transit of the primary case 2*a* allows for easy change-over from the transit mode to the operational mode because the secondary cover 24 preferably has the same dimensions, mating surface 46, and closure system 95 as the cover 20*a* used during transit.

The externally mounted thermoelectric air conditioner 7 embodiments may also include a separate cover/lid 25 to cover the exposed portion of the thermoelectric air conditioner 7. For example, in the exemplary through-mounted embodiment shown in FIG. 11, the cold side 76 of the thermoelectric air conditioner 7 extends through an opening 15 in the case wall 10 and hence is located and protected within the outer boundary of the transit case 2. The hot side 77 of the thermoelectric air conditioner 7 is outside the outer boundary.

The hot side 77 of the thermoelectric air conditioner 7 in this embodiment may be protected by a separate, secondary cover/lid 25. A secondary cover/lid 25 may also be used with an external, flush-mounted embodiment.

Figure 12A:
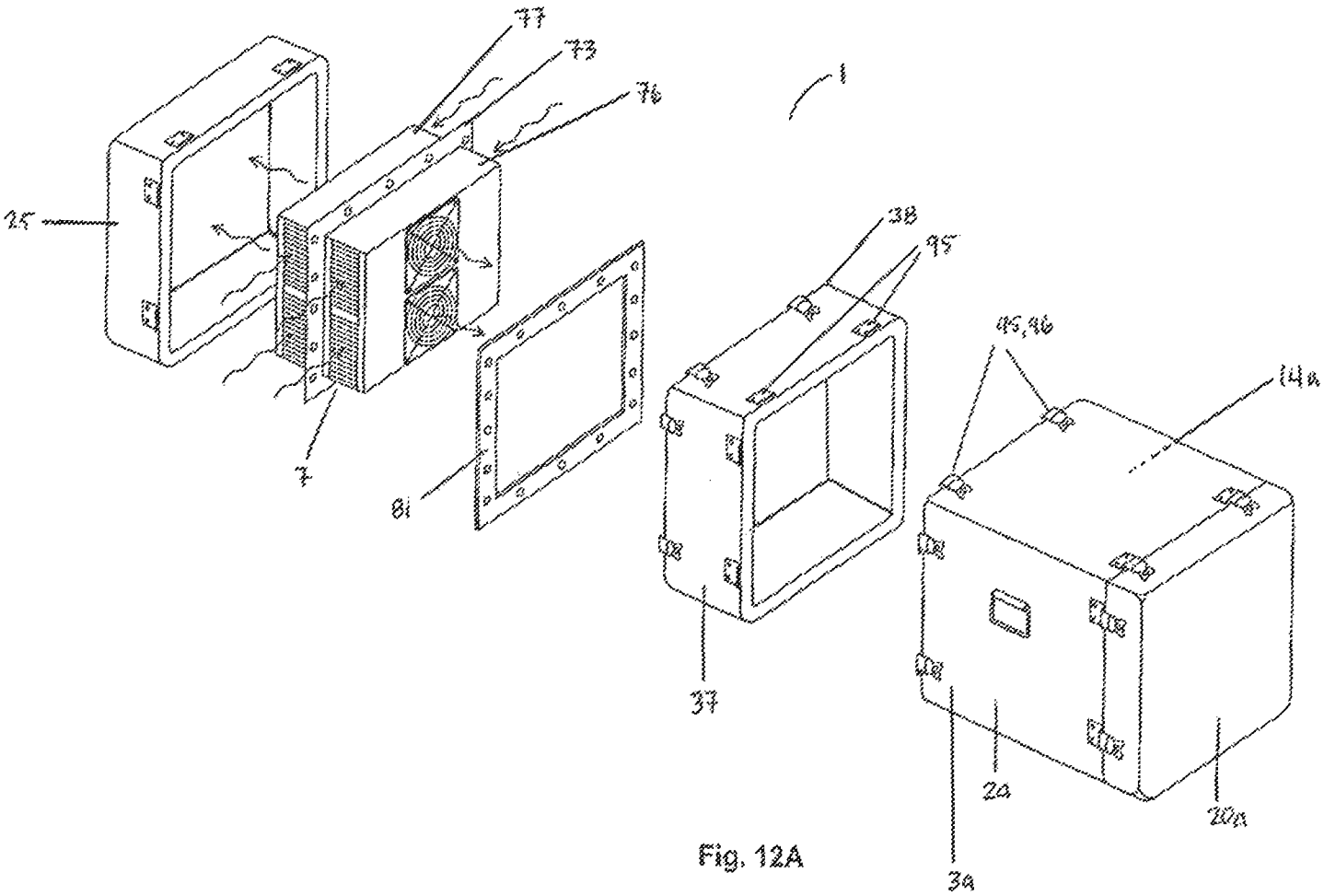
FIGS. 12A and 12B are an exploded perspective view of another exemplary embodiment of a thermoelectric air conditioned transit case having an extender piece for mounting the thermoelectric air conditioner to the transit case.
Figure 12B:
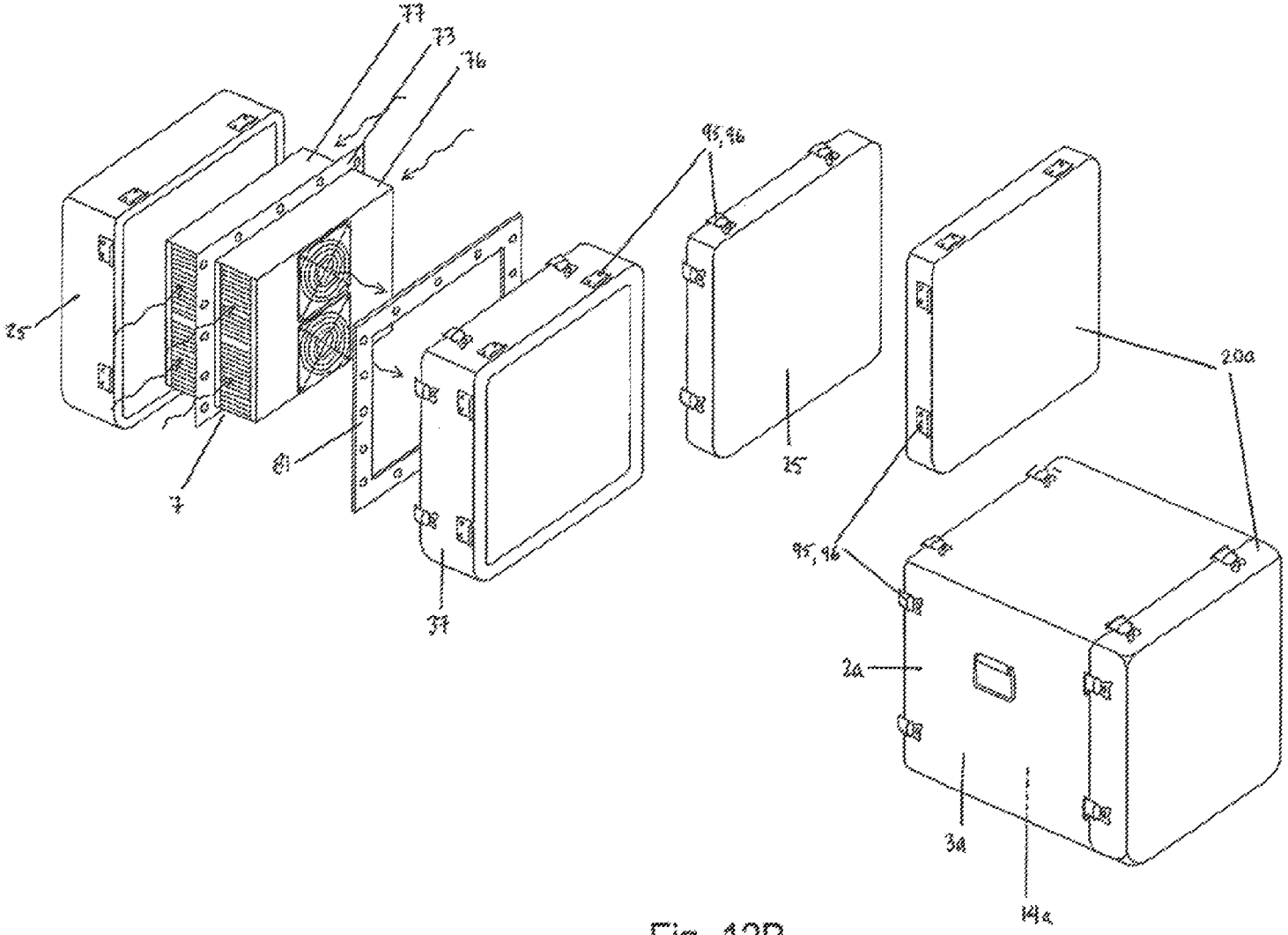

The embodiment of FIGS. 12A and 12B includes a thermoelectric air conditioner 7 mounted to a transit case 2*a* using an extender piece 37 (i.e., an adapter/spacer/extension section). This transit case extender piece 37 is designed to attach to the primary transit case 2*a* in place of one of the primary transit case 2*a* covers/lids 20*a* and provide temperature control within the internal cavity 14*a* of the primary case 2*a*, in which the equipment 5 is housed.

FIG. 12A shows a thermoelectric air conditioner 7 mounted in a transit case extender piece 37 that is mounted vertically to the end of the primary transit case 2. Preferably, a sealing gasket 81 is disposed between the mounting flange 73 of the thermoelectric air conditioner 7 and the mounting flange 38 of the extender piece 37. Preferably, the existing closure system 95 (as shown latches 96) of the primary case 2*a* are used to engage corresponding closure mechanism 95 on the extender piece 37 to hold the extender piece 37 to the primary case 2*a*.

As shown in FIG. 12B, separate covers 25 may be attached to the ends of the transit case extender piece 37 to protect the thermoelectric air conditioner 7 during transport or storage. Alternatively, the transit case extender 37 can be left attached to the primary case 2*a* with a cover 25 added to protect the thermoelectric air conditioner 7 during transport and storage.

Figure 13B:
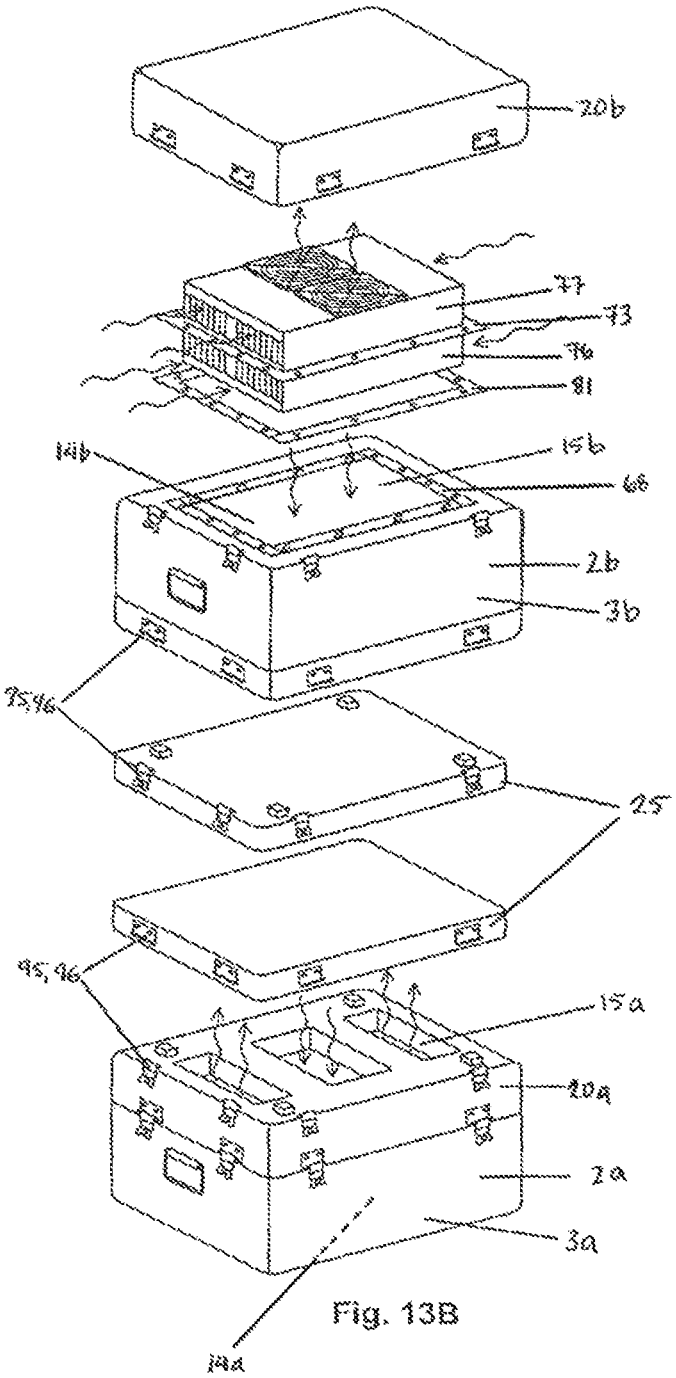

Alternatively, the thermoelectric air conditioner 7 and extender piece 37 can be mounted horizontally to the top of the primary transit case 2*a* (similar to the embodiment shown in FIGS. 13A and 13B). A separate cover 25 may then be attached to the top of the transit case extender piece 37 to protect the thermoelectric air conditioner 7 during transport or storage.

In another embodiment shown in FIG. 13A, the thermoelectric air conditioner 7 may be located in a separate, secondary case 2*b* during transit that can be connected to the case 2*a* housing the equipment 5 to be protected during operation. Preferably, a sealing gasket 81 is disposed between the mounting flange 73 of the thermoelectric air conditioner 7 and the mounting flange 68 of the secondary case 2*b*. Preferably, the existing closure system 95 (as shown latches 96) of the primary case 2*a* are used to engage a corresponding closure mechanism 95 on the secondary case 2*b* to hold the secondary case 2*b* to the primary case 2*a*.

The secondary case 2*b* housing the thermoelectric air conditioner 7 may be connected—one on top of the other (as shown in FIG. 13A) or end-to-end (similar to the extender piece embodiment shown in FIG. 12A)—to the primary case 2*a* housing the equipment 5 and then placed in-service to control the temperature of the internal cavity 14*a* of the primary case 2*a* to protect the equipment 5 housed therein. In use, the cold side 76 of the thermoelectric air conditioner 7 in the secondary case 2*b* is in thermal communication with the internal cavity 14*a* of the primary case 2*a*. As shown in FIG. 13B, removable covers 25 may be attached to the corresponding mating ends of the primary 2*a* and secondary transit cases 2*b* to protect the thermoelectric air conditioner 7 during transport or storage.

In addition, the thermoelectric air conditioner 7 can be mounted in either a vertical or horizontal orientation. For example, in the illustrated embodiments of FIGS. 1-4, 12A, and 12B, the thermoelectric air conditioner 7 is mounted vertically proximate an opening 15 at one end/side of the case 2. In the embodiments of FIGS. 5-11, 13A, and 13B, the thermoelectric air conditioner 7 is mounted horizontally proximate an opening 15 in the top of the case 2.

It is also contemplated that more than one thermoelectric air conditioner 7 can be mounted in or on a transit case 2. For example, for a transit case 2 having front and rear covers 20, such as FIGS. 1-4 and 21A-21F, one thermoelectric air conditioner 7 could be mounted in or on the front opening 15 and a second thermoelectric air conditioner 7 could be mounted in or on the rear opening 15. Further, one thermoelectric air conditioner 7 could be top mounted while a second-thermoelectric air conditioner 7 could be end mounted.

The thermoelectrically air conditioned transit case 1 houses and protects sensitive equipment 5 contained within the case 2 during transit (i.e., shipment from one location to another location) and during use of the equipment 5 at remote locations. The thermoelectrically air conditioned transit case 1 includes a durable case 2 or housing coupled with a thermoelectric air conditioner 7 and is designed to protect sensitive equipment 5 stored therein from environmental conditions, including for example extreme temperature. Preferably, the thermoelectrically air conditioned transit case 1 is also constructed to be contaminant-tight (e.g., airtight, watertight, and dustproof) and to protect the equipment 5 from other environmental conditions including impact, shock, vibration, vandalism, and contaminants—such as air, water, moisture, humidity, dirt, dust, debris, chemicals, etc. The thermoelectric air conditioner 7 is capable of driving the temperature inside the transit case to a temperature below ambient.

The thermoelectrically air conditioned transit case 1 is designed to protect sensitive equipment and/or systems from the rigors of: commercial and industrial use; air, land, and sea shipment; temporary storage; worldwide military deployment; movements between remote locations; use at remote locations; and the like. Preferably the thermoelectrically air conditioned transit case 1 also enhances handling and the overall portability of the application, as explained more fully below.

Transit cases are known by various names. As used herein, the term transit case includes portable cases used to house, store, ship, transport, and protect equipment and/or systems in transits from one location to another location or as the equipment/system is used at a remote location. The thermoelectrically air conditioned transit case 1 is designed and constructed to protect temperature sensitive equipment and/or systems. Temperature sensitive equipment and/or systems include, for example, electrical, electronics, computer, server, weapons, mobile command and control, deployed air traffic control, surveillance, global positioning, instrumentation, communication, and the like.

Transit cases are manufactured by various manufacturers and come in a variety of styles, sizes, and shapes. In addition, the thermoelectric air conditioner 7 also comes in a variety of capacities to handle different loads and sizes of transit cases. The present invention contemplates the refabrication/retrofitting of existing transit cases 2 to include a thermoelectric air conditioner 7, as well as implementation and installation of the thermoelectric air conditioner 7 during, or as part of, the original manufacturing of the transit case 2.

The thermoelectrically air conditioned transit case 1 includes a portable protective housing 3 that is preferably light-weight, simple to design, rugged in construction, and economical to manufacture. Preferred material characteristics of the case include: high performance, impact-resistant, corrosion-resistant, UV-resistant, temperature-resistant, water-resistant, strong, durable, and the like. Suitable case materials include: Thermo Stamped Composite or TSC, which is glass-reinforced polyethylene, Rotomolded PE (polyethylene), injection molded ABS, Fiberglass (FRP), polyethylene for high impact strength, high impact structural copolymer, plastic, aluminum, plywood, canvas, nylon, leather, denim, polyester, light-weight metals, and other materials. Exemplary manufacturing techniques include rotational mold, injection mold, roto-mold, blow-mold, thermoformed processes, welded aluminum, drawn aluminum, and the like.

The case 2 of the thermoelectrically air conditioned transit case 1 can be manufactured as a standard case having standard dimensions and/or as a custom case that is manufactured to specific customer needs. For example, the case 2 can be manufactured to fit a particular payload and/or suite of equipment for a particular application, such as commercial, government, military, Homeland Security, etc.

Further, many military and defense customers require that cases meet certain design, environmental, and/or performance standards, such as MIL-STD-810 (shock, transit drop, vibration, water-tight, etc.); MIL-STD-1472 (lift limitations, see FIG. 14); MIL C-4150J; ATA (Air Transportation Association); loose cargo bounce; high/low temperature range; relative humidity; altitude, ultraviolet (UV) radiation; fungus; static loading; and the like. Preferably the design and construction of the thermoelectrically air conditioned transit case 1 take these design parameters and limitations into consideration.

Preferably, the thermoelectrically air conditioned transit case 1 is contaminant-tight (e.g., water-tight, air-tight, dust proof, etc.) when the cover 20 (and/or cover 25) is closed. Also, the interface between the thermoelectric air conditioner 7 and the transit case 2 is preferably contaminant-tight when the cover 20 of the transit case 2 is open. In addition, the interface between the hot side 77 and the cold side 76 of the thermoelectric air conditioner 7 is also preferably contaminant-tight.

The thermoelectrically air conditioned transit case 1 preferably includes a case closure system to close and seal any openings in the case 2. For example, the case 2 closure system can include one or more covers and/or lids 20, 25. Covers/lids 20, 25 are used to close openings 15 in the case 2 used to, for example, allow access to the internal cavity 14 of the case 2 to load or access equipment 5. The covers/lids 20, 25 may be removably or pivotally mounted to the case 2. In embodiments having covers/lids 20, 25 pivotally mounted to the case, the covers/lids 20, 25 may be attached using one or more hinges 27.

In addition, the closure system preferably includes a closure mechanism 95, such as one or more latches 96. Case closures 95 are preferably heavy-duty, secure, strong, and easy to operate. Types of suitable case closures 95 include twist latches, "press and pull" latches, etc. In an exemplary embodiment, the latch 96 imposes an impact compressive force to seal cover/lid 20, 25 to the enclosure opening 15 when the latch 96 is closed. Preferably the latches 96 are located in a cavity or recess 97 formed in the body of the case 2 so the latches 96 are not in the way during handling or shipping of the case 2.

Further, the case closure system can include a sealing system between the cover/lid 20, 25 and the case opening 15. For example, the sealing system can include a tongue 84 and groove 85 located around the perimeter of an opening 15 to seal the cover/lid 20, 25 over the opening 15 when the case 2 closure is activated. The tongue 84 and corresponding groove 85 are preferably located having one structure on the case 2 and the corresponding structure on the cover/lid 20, 25. In addition, a gasket 81 may be used to seal the connection of the cover/lid 20, to the case opening 15.

Moreover, the case closure system can include a lock (not shown) for securing the cover/lid 20, 25 over the opening 15 in the case 2. The lock 98 may include any conventional locking mechanism and may be incorporated into the case 2 body or be a separate lock 98 that is independent from the case. The lock 98 helps deter tampering, theft, vandalism etc.

The portable thermoelectrically air conditioned transit case 1 preferably includes a case handling system. In one embodiment, the case handling system includes one or more handles 91. Exemplary handles 91 include molded-in and/or hinged designs and the handles 91 may be sized and padded for comfort and ease of handling.

In another embodiment, the thermoelectrically air conditioned transit case 1 can include wheels or casters 100 to further assist in the portability of the case. The case can also include a cargo handling system, such as slots 101 formed in the bottom of the case to accommodate the forks of a fork-lift machine, eye-bolts (not shown) on top of the case to accommodate a crane, and the like.

The case closure system and handling system are preferably located at convenient locations on the housing and do not interfere with the operation, storage, or movement of the transit case. For example, preferably the latches 96, handles 91, etc. are located in grooves 92 or recesses 97 in the housing 2 and are positioned within the groove 92 or recess 97 when not in use and are accessible or capable of moving out of the groove 92 or recess 97 when in use. For example, the handles 91 can include swing-out handles.

In certain embodiments it may be desirable to store multiple thermoelectrically air conditioned transit cases 1 together either end to end or one on top of another. For those embodiments it is preferred that the thermoelectrically air conditioned transit cases 1 are stackable. The thermoelectrically air conditioned transit cases 1 may be stacked end-to-end and/or one on top of another. As shown in FIG. 10A, the housing or body 3*a* of the case 2*a* may include a shoulder 103 and slot 104 design wherein the shoulder 103 of one case would be received within a corresponding slot 104 of an adjoining case 2*a*. In addition, an interlock system (not shown) can be used wherein adjoining cases 2*a* could be locked together during, for example, transit, storage, and/or use. The interlocking system can include latches, ties, tie-downs, straps, belts, bands, and the like.

The thermoelectrically air conditioned transit case 1 can also include a mounting system for mounting the thermoelectric air conditioner 7 within the case. In one preferred embodiment, the mounting system includes a rack-mount frame 40.

Figure 4:
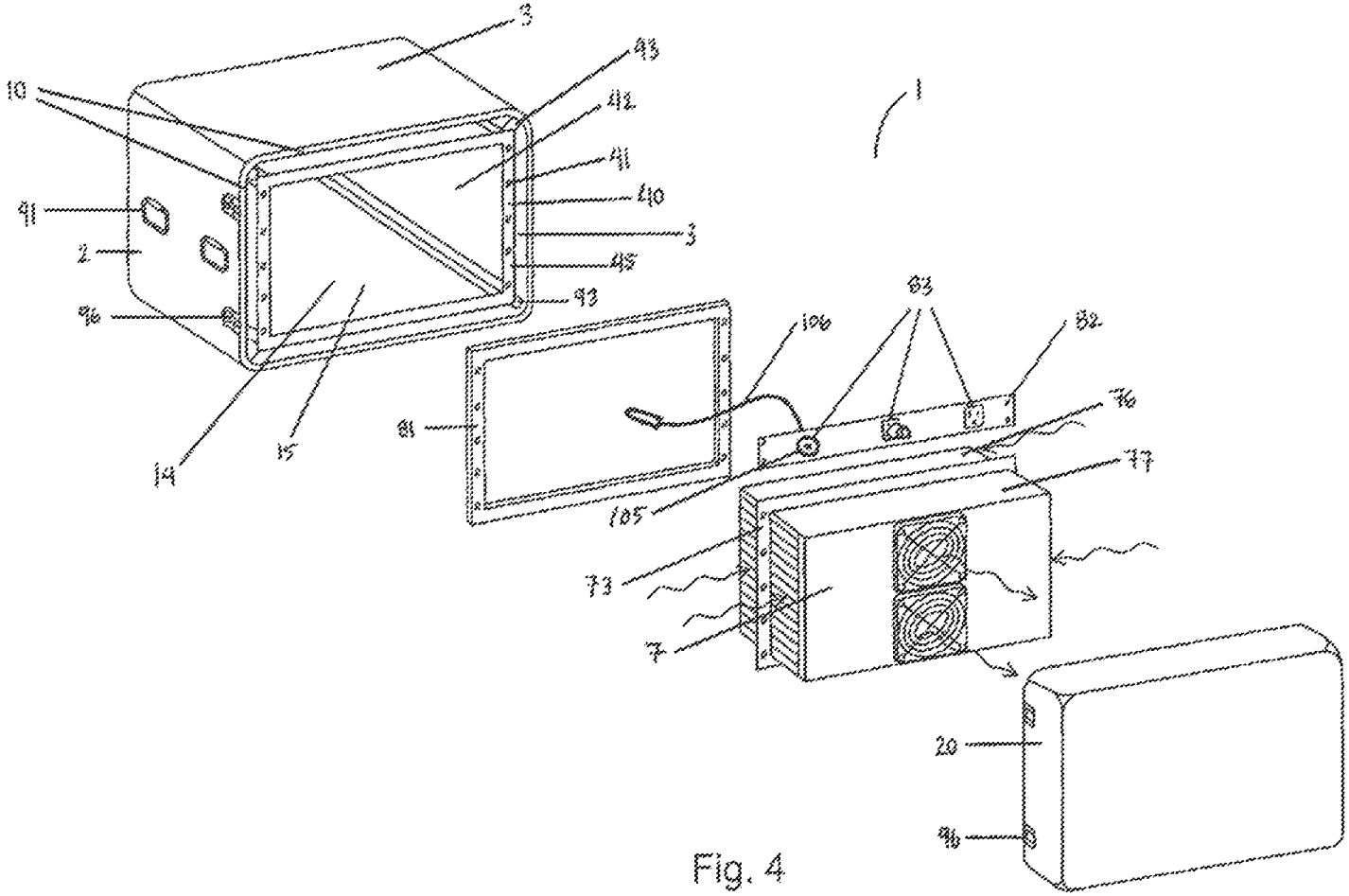
FIG. 4 is an exploded view of the exemplary thermoelectrically air conditioned transit case of FIG. 1.

A rack-mount frame 40 is a supporting frame disposed within the housing 3 and spaced from the walls 10 and having an opening 42 on at least one side facing an opening 15 in the transit case 2 housing 3 for receiving the thermoelectric air conditioner 7. As shown in FIG. 4, the thermoelectric air conditioner 7 includes a portion (i.e., the "cold side" 76) that can fit an opening 42 formed between the vertical rack rails 45 of the mounting frame 40 and the thermoelectric air conditioner 7 can be connected to the mounting frame 40 of the rack rails 45. As shown in FIG. 21C, the rack-mount frame 40 may also be used to hold other equipment, including the equipment 5 designed to be protected and cooled by the thermoelectric air conditioner 7.

In the rack-mount 40 thermoelectric air conditioner 7 embodiment, the thermoelectric air conditioner 7 is mounted directly to the rack-mount frame 40 within the internal cavity 14 of the transit case 2. The rack-mount frame 40 preferably includes standard mounting holes 41 and fasteners 43 for holding the thermoelectric air conditioner 7 and/or the equipment 5 in the rack 40. For example, the rack-mount frame 40 can be designed in accordance with EIA-RETMA standards for portable electronics and include standard front mounting holes 41 and locking clip-nut fasteners 43 for holding the equipment 5 in the rack 40.

The rack-mount frame 40 can include standard and custom rack-mounts. Standard rack-mounts include 19-inch, 23-inch, and 24-inch rack-mounts. Also, other standard sizes, as well as, custom rack-mount cases having varying dimensions can be used. In other embodiments, the rack-mount frame 40 can include multiple, different size racks, custom racks, and/or adjustable mounting frames.

In addition, a separate, adapter plate 82 can be used to fill-in or close the gap between the thermoelectric air conditioner 7 and the internal sides of the transit case 2. The adapter plate 82 preferably includes a seal and/or gasket 81 that forms a boundary between the thermoelectric air conditioner 7 and the case 2. This further enhances the ability of the transit case 2 to maintain, as close as possible, an airtight status and seal contaminants from the interior 14 of the case 2. Further, the adapter plate 82 is preferably insulated to improve thermal efficiency.

The adapter plate 82 can extend around one or more sides of the thermoelectric air conditioner 7. As shown in FIG. 4, the adapter plate 82 extends across and closes the gap between the top of the thermoelectric air conditioner 7 and an interior surface of the top of the case 2. In a preferred embodiment, the adapter plate 82 is a solid piece to facilitate maintaining a contaminant-tight seal. Alternatively, the adapter plate 82 can include one or more sealed exit ports 83, such as, for example, sealed cable exits, sealed control exits, and/or a sealed power receptacle. The adapter plate 82 can also include one or more controls 105 for controlling and monitoring an operation of the thermoelectric device. For example, a thermostat dial 105 can be provide on the adapter plate 82 for setting an output temperature of the thermoelectric device.

Further, in certain embodiments where the thermoelectric air conditioner 7 is installed on one end of the internal rack-mount frame 40, a weight distribution problem might result. For example, consider an arrangement of mounting a thermoelectric air conditioner 7 in a transit case having a weight load of perhaps 60 lbs. on one end of the frame. If the end user were to install a minimal amount of electronics (i.e., 5 lbs.) on the other end of the rack 40, this could result in an unbalanced load and the ruggedness and protection level of the case 2 could be compromised in such a scenario. However, the present invention solves this problem by providing for the installation of internal elastomer shocks 93 with different load ratings and/or additional shocks, thus balancing the load on the frame and taking into consideration the CG (center of gravity) of the load.

In other embodiments where impact sensitive equipment is stored within the case 2, the thermoelectrically air conditioned transit case 1 can include a shock, vibration, and/or noise mitigating system. In these impact sensitive embodiments, the case is preferably shock, vibration, and/or noise absorbing ("shock absorbing"). For example, elastomer shock mounts 93 can be used between the thermoelectric air conditioner 7 and the case 2 to isolate the thermoelectric air conditioner 7 and absorb any shock or vibration. In a rack-mount 40 embodiment, shock mounts 93 can be located inside the case 2, for example, between the frame of the rack-mount frame 40 and the housing 3 of the case 2. This design provides protection to the thermoelectric air conditioner 7 and equipment 5 mounted to the frame of the rack-mount 40 housed within the case 2. Also, if the thermoelectrically air conditioned transit case 1 is made from a plastic material, the plastic material itself can be shock absorbing and the case absorbs some of the shock.

In addition, a cushioning system can be provided to further hold and protect the thermoelectric air conditioner and equipment 5 located within the thermoelectrically air conditioned transit case 1. For example, a customizable foam interior (not shown) can be used with the shape and amount of foam determined by the shape and the characteristics of the equipment 5 being protected. The cushioning system can be manufactured into the case or can be insertable. The cushioning system decelerates the equipment 5 in a controlled manner if the case is dropped or otherwise subjected to shock or vibration.

As shown in FIGS. 5, 7A, 7B, 10B, and 10C, the thermoelectrically air conditioned transit case 1 preferably includes a pressure relief valve 86 that equalizes the pressure inside and outside the case 2. In a more preferred embodiment, the pressure relief valve 86 is an automatic pressure relief valve that automatically equalizes the pressure. The pressure relief valve 86 provides a watertight and airtight seal during transit, such as air travel where the thermoelectrically air conditioned transit case 1 experiences varying elevations, and thus pressures.

FIGS. 15-18 show an exemplary thermoelectric heat exchanger. The thermoelectric heat exchanger in this case, a thermoelectric air conditioner 7 for cooling the inside or internal cavity 14 of the case 2, includes one or more thermocouples and at least one heat sink 126, 128. The thermocouples are made from semiconductors and the semiconductor is heavily doped to create an excess (n-type) and a deficiency (p-type) of electrons. The junction between the n-type and the p-type is a semiconductor thermocouple. At the cold side 76, energy (heat) is absorbed by electrons as they pass from a low energy level in the p-type semiconductor element, to a higher energy level in the n-type semiconductor element. The power supply provides the energy to move the electrons through the system. At the hot side 77, energy is expelled to a heat sink 128 as electrons move from a high energy level element (n-type) to a lower energy level element (p-type). Heat absorbed at the cold side 76 is pumped to the hot side 77 at a rate proportional to current passing through the circuit and the number of couples.

These thermocouples, which can be connected in series electrically and in parallel thermally, are integrated into the thermoelectric air conditioner 7. The thermoelectric modules 141 are packaged between metallized ceramic plates. Thermoelectric modules 141 can be mounted in parallel to increase the heat transfer effect or can be stacked in multi-stage cascades to achieve high differential temperatures. Solid state cooling is relatively simple compared to some of the classical techniques, such as using a compressor, because there are no moving parts (other than fans).

These thermoelectric devices have the capability to be either heating systems or cooling systems depending on the direction of the current. In addition, the thermoelectric devices can include embedded resistive heaters within the cold side in order to effect heating within the internal cavity 14. The following description focuses on a thermoelectric heat exchanger that is used for cooling, i.e., a thermoelectric air conditioner 7. In the cooling embodiment shown and described, the thermoelectric air conditioner 7 is designed to exhaust heat from inside the transit case 2 to outside the transit case 2 to protect thermally sensitive equipment 5 in the transit case 2.

Unlike a conventional air conditioner, the thermoelectric air conditioner 7 used to cool equipment 5 within the transit case 2 is a solid state device and has no compressor, refrigerants or filters, and provides reliable, maintenance-free cooling of the interior (i.e., internal cavity) of the transit case 2.

Preferably the thermoelectrically air conditioned transit case 1 is designed and constructed to increase contaminant resistance (i.e., minimizing the transfer of contaminants from the hot side—or outside of the transit case 2—to the cold side—or inside of the transit case 2) and to improve thermal efficiency (i.e., minimize the transfer of thermal energy from the hot side—or outside—to the cold side—or inside—by increasing thermal isolation between the hot side and the cold side).

For example, the thermoelectric air conditioner 7 is preferably sealed to be contaminant-resistant and to minimize heat transfer between the hot side 77 and the cold side 76. Also, the connection between the thermoelectric air conditioner 7 and the transit case 2 is also preferably designed to be contaminant-resistant and to improve thermal efficiency. In addition, that transit case housing 3 and cover(s) 20, 25 are preferably designed to be contaminant-resistant and thermally efficient.

Contaminant-resistant means zero or substantially zero contaminants will pass between the hot side 77 and the cold side 76 of the thermoelectric air conditioner 7 and/or from the outside to the inside of the transit case 2. By making the thermoelectrically air conditioned transit case 1 contaminant-resistant, the long term reliability and performance of the equipment 5 stored in the transit case 2 may be improved by minimizing any damage from outside contaminants.

Thermal efficiency means reducing/minimizing thermal heat transfer from the hot side 77 to the cold side 76 of the thermoelectric air conditioner 7 and/or from outside the transit case 2 to inside the transit case 2. Thermal efficiency can be increased by, for example, using a reflective material on the outside of the case 2, using a UV resistant material for the case 2, using an insulating material around the inside of the case 2, using an insulating material at the connection between the thermoelectric air conditioner 7 and the case 2, and the like. Thermal efficiency can also be increased by designing the system with heat producing electrical components being mounted on a power pack heat sink 127, which exhausts heat to the hot side 77 of the thermoelectric air conditioner 7. Therefore, the heat generated from the heat producing components is dissipated directly to the hot side 77 of the thermoelectric air conditioner 7.

FIGS. 15-18 show various features of an exemplary thermoelectric air conditioner 7. As shown, in FIG. 15, the thermoelectric air conditioner 7 includes a housing having a cold side cover 110 that covers the components on a cold side 76 of the thermoelectric air conditioner 7, a hot side cover 111 that covers the components on a hot side 77 of the thermoelectric air conditioner 7, and a mounting frame 72 positioned between cold side cover 110 and hot side cover 111.

As shown, mounting frame 72 includes a mounting flange 73 formed over the outer periphery of at least two sides of mounting frame 72 and that extend outside of the housing. A plurality of through holes 74 are formed in mounting flange 73 for mounting the thermoelectric air conditioner 7 directly to the transit case 2 or to a mounting frame 40 within the transit case 2. In the embodiment shown, the mounting frame 72 also includes a plurality of through holes 113, corresponding to through holes 118, 135 in the cold side cover 110 and the hot side cover 111 for mounting both cold side cover 110 and hot side cover 111 to mounting frame 72.

Cold side cover 110 includes a substantially planar body 114 having side walls 115 that define a cold side cavity 116. Opening 117 allows air to access the cold side cavity 116.

As shown, a cold side fan 123 is mounted to cold side cover 110 proximate to fan opening 122. Cold side fan 123 forces air through the fan opening 122, across the cold side 76 of the thermoelectric air conditioner 7, and out of the opening 117.

In a typical mounting to a transit case 2, cold side cover 110 extends into or is in thermal communication with the internal space 14 of the transit case 2 and hot side cover 111 extends outside of or is in thermal communication with the outside of the transit case 2.

Figure 15:
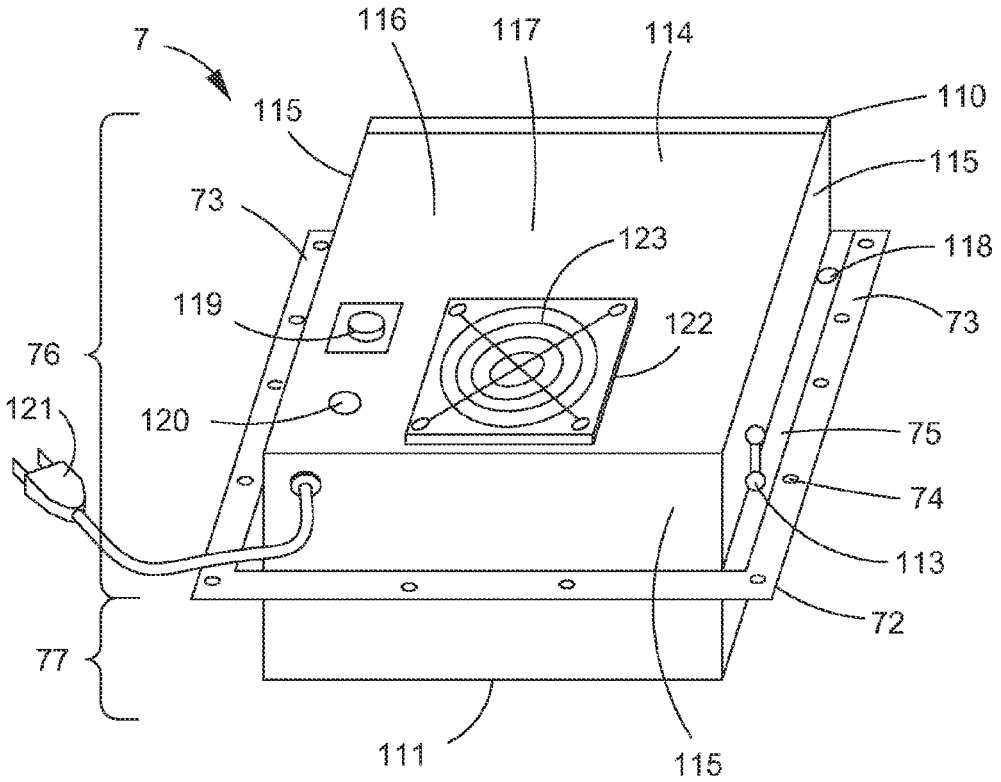
FIG. 15 is a perspective view of an exemplary thermoelectric air conditioner in accordance with the present invention.

As shown in FIG. 15, the thermoelectric air conditioner 7 includes one or more controls, including a thermostat control knob 119 to allow an operator to adjust the temperature setpoint of the thermoelectric air conditioner 7, a circuit breaker 120 to trip the device on, for example, an over-current condition, a power cord 121 for supply power to the device, and the like.

Figure 16:
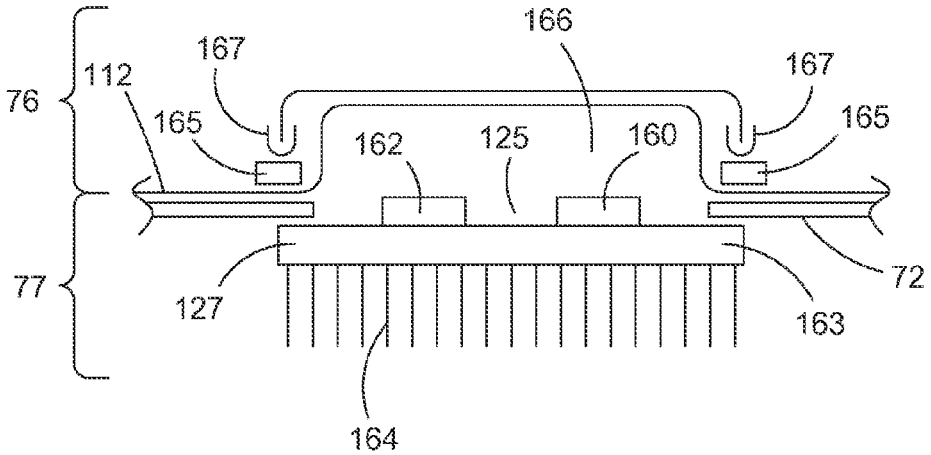
FIG. 16 is a cross sectional view of the thermoelectric air conditioner of FIG. 15.

FIG. 16 is a cross sectional view of an exemplary thermoelectric air conditioner 7 showing a barrier 112 between the cold side 76 and the hot side 77. Power pack heat sink 127 includes a base portion 163 having with a plurality of fins 164 extending from one side of the base portion 163. Power pack heat sink 127 is mounted, proximate to power pack cutout 125, on the hot side 77 of mounting frame 72, with the base portion 163 proximate to the mounting frame 72. Gasket 165 is attached to the cold side 76 of the mounting frame 72 proximate to the power pack cutout 125. Preferably, power pack cover 158 is secured to gasket 165 with cover seal 167 proximate to the gasket 165. Electrical components 159, 160, 161, and 162 (159 and 161 not shown) are mounted to the base portion 163 of the power pack heat sink 127 and protrude through power pack cutout 125 in mounting frame 72 into a cavity 166. Mounting frame 72, gasket 165, and power pack cover 158 define a non-planar barrier 112 between a cold side 76 and a hot side 77.

Figure 17:
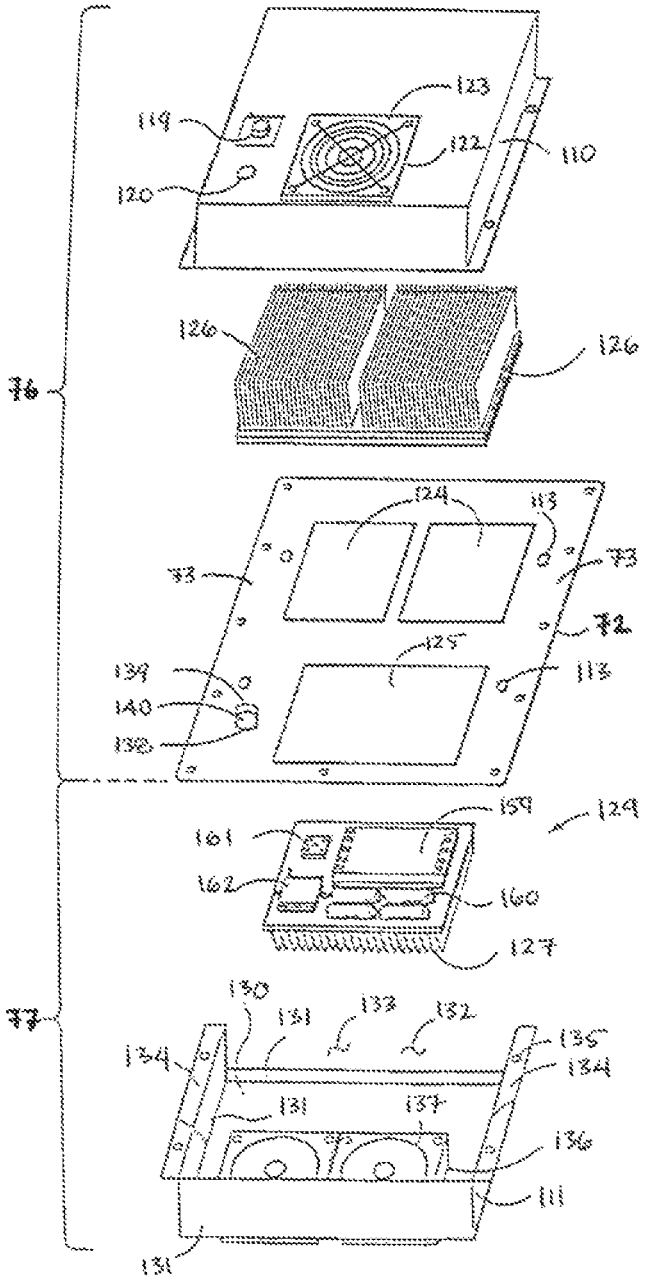
FIG. 17 is an exploded perspective view of the thermoelectric air conditioner of FIG. 15.

FIG. 17 shows the interior of the housing of FIG. 15. As shown in FIG. 17, the housing includes mounting frame 72, cold side cover 110, and hot side cover 111. In the embodiment shown, the mounting frame 72 includes two heat sink cutouts 124 and one power pack cutout 125. Mounting frame 72 is located between the cold side 76 and the hot side 77. The cold side 76 includes cold side heat sinks 126. Cold side heat sinks 126 are attached on the cold side 76 of mounting frame 72. The hot side 77 includes power pack heat sink 127 and at least one hot side heat sinks 128. Hot side heat sinks 128 are attached on the hot side of mounting frame 72. Power pack heat sink 127 is attached on the hot side of mounting frame 72.

Power supply assembly 129 may include power pack heat sink 127, and a plurality of electrical components including, for example, a DC to DC active power supply 159, one or more filter capacitors 160, a bridge rectifier 161, and a noise suppression filter 162, and associated circuitry (not shown).

Hot side cover 111 includes a substantially planar body 130 having side walls 131 that define a hot side cavity 132. Opening 133 allows air to access the hot side cavity 132. Hot side cover 111 includes mounting brackets 134 that extend outward from side walls 131. The mounting brackets 134 includes a plurality of through holes 135 for receiving fasteners (not shown) for mounting the hot side cover 111 to the mounting frame 72. Mounting frame 72 includes through holes 113 corresponding to through holes 135 of hot side cover 111. Fasteners (not shown) pass through holes 113 and through holes 135 to secure hot side cover 111 to mounting frame 72.

Figure 18:
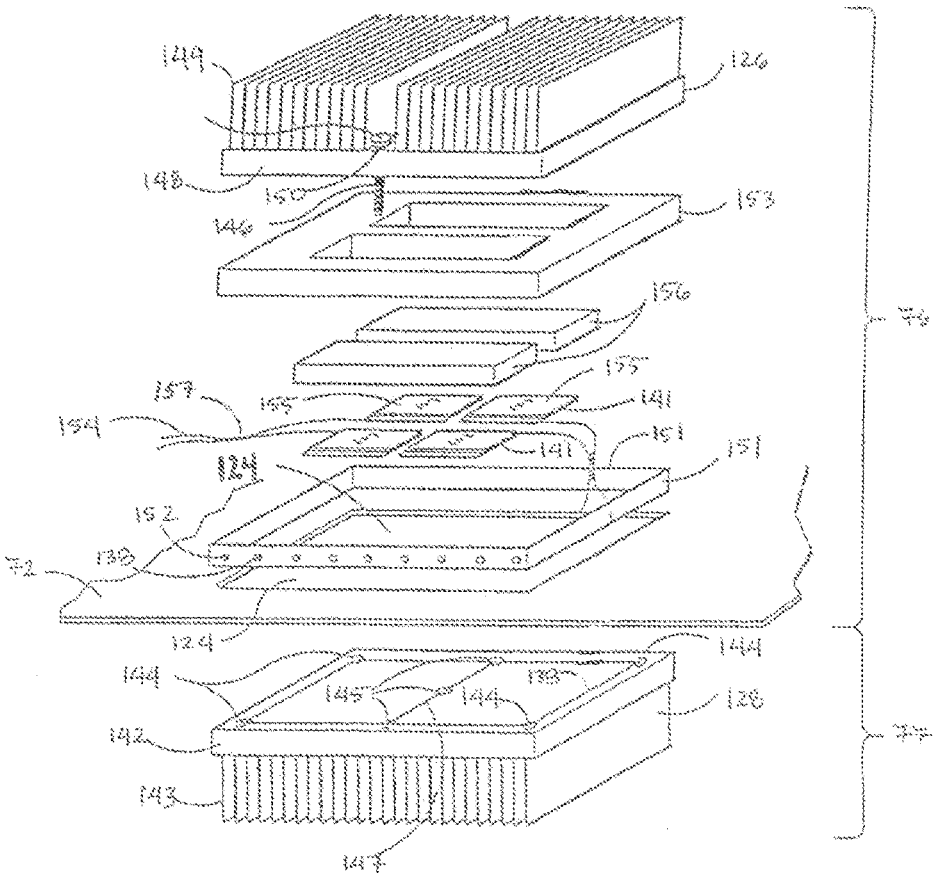
FIG. 18 is an exploded perspective view of an exemplary heat exchanger in accordance with the present invention.

The hot side includes one or more hot side fans 137 mounted proximate fan openings 136 in hot side cover 111. The hot side fans 137 draw air across the power pack heat sink 127 to remove heat and also force air through the fan openings 136, across the hot side 77 of the thermoelectric air conditioner 7, and out of the opening 133. Hot side heat sinks 128, (which are shown in FIG. 18) are mounted to the hot side 77 of mounting frame 72. Hot side fans 137 also draw air across hot side heat sinks 128 to expel heat to the outside of the thermoelectric air conditioner 7.

A wire feed opening 140 is located in mounting frame 72 and provides access for running wires (not shown) between the hot side 77 and cold side 76. Wires are disposed through the wire feed opening 140 and sealed completely by a liquid tight compression fitting 139 disposed in wire feed opening 140. The liquid tight compression fitting 139 may increase thermal efficiency by preventing moisture and heat from reaching the cold side 76. The liquid tight compression fitting 139 may also increase the life of the thermoelectric air conditioner 7 by preventing moisture from reaching electrical components 159, 160, 161 and 162, thereby, increasing the life of the electrical components. As shown in FIG. 17, the electrical components include a DC to DC active power supply 159, filter capacitors 160, a bridge rectifier 161, and a noise suppression filter 162, and associated circuitry (not shown). Sealant 138 may be disposed in wire feed opening 140 to further seal the wire feed opening 140.

FIG. 18 is an exploded perspective view of an exemplary thermoelectric air conditioner 7. As shown in FIG. 18, thermoelectric air conditioner 7 includes at least one thermoelectric module 141, at least one hot side heat sink 128, and at least one cold side heat sink 126. Mounting frame 72 includes at least one heat sink cutout 124. Heat sink cutout 124 allows the thermoelectric modules 141 to contact both the hot side heat sink 128 and the cold side heat sink 126. The contact between hot side heat sink 128 and cold side heat sink 126 provides for heat transfer between the cold side 76 and the hot side 77 allowing the internal cavity of the transit case to be cooled.

As shown, hot side heat sink 128 includes a base portion 142 and a plurality of fins 143 extending in a substantially orthogonal direction from the base portion 142. The plurality of fins 143 provides more surface area for better heat transfer.

Hot side heat sink 128 is preferably attached to the hot side 77 of mounting frame 72, proximate to heat sink cutout 124 through blind holes 144 and fasteners 146. The blind holes 144 provide for attachment to the mounting frame 72 without providing a path for air and moisture. This provides a moisture resistant barrier between the hot side 77 and the cold side 76, increasing thermal isolation and minimizing the risk of moisture reaching the thermoelectric modules 141 or electrical components 159, 160, 161 and 162 (not shown). The use of blind holes 144 also maximizes thermal isolation creating a moisture resistant barrier between the hot side 77 and the cold side 76.

In a preferred embodiment, a sealant is placed around the perimeter of the base, between the hot side heat sink 128 and the mounting frame 72 to further seal any gaps, providing moisture resistance and thermal isolation. This moisture resistance feature functions to increase the long-term reliability of the thermoelectric air conditioner 7.

Preferably, hot side heat sink 128 also includes a plurality of blind holes 145 located along a centerline 147 of the base, opposite the plurality of fins 143. Blind holes 145 are provided to attach the cold side heat sink 126 to the thermoelectric air conditioner 7 using fasteners 146. The blind holes 145 provide for attachment to the mounting frame 72 without providing a path for air and moisture. This minimizes the risk of moisture passing between the hot side 77 and the cold side 76, increasing thermal isolation and minimizing the risk of moisture reaching the thermoelectric modules 141 or electrical components 159, 160, 161 and 162 (not shown). The use of blind holes 145 also maximizes thermal isolation by not allowing air or moisture to flow between the hot side 77 and the cold side 76.

The thermoelectric air conditioner may also include a sealing frame 151 adapted to allow one or more thermoelectric modules 141 to be disposed therein and to contact the hot side heat sink 128 and the cold side heat sink 126. As shown, sealing frame 151 is attached to the cold side 76 of the mounting frame 72, proximate to heat sink cutout 124, with fasteners (not shown) secured into the blind holes 144 of the hot side heat sink 128. The sealing frame 151 provides the ability to seal against the mounting frame 72, to secure insulation 153 in place, and to seal between the sealing frame 151 and the cold side heat sinks 126. A sealant 138 is preferably placed between the sealing frame 151 and the mounting frame 72 and between the sealing frame 151 and the cold side heat sink 126.

Thermoelectric modules 141 have a relatively flat and planar body and, as shown in FIG. 18, have a substantially rectangular shape. At least two wires 154 are attached to the thermoelectric modules 141. Wires 154 provide a means for applying power to the thermoelectric modules 141. At least one thermoelectric modules 141 are affixed to each hot side heat sink 128, substantially coplanar with the mounting frame 72. Preferably, the thermoelectric modules 141 are substantially centered within each quadrant of sealing frame 151.

Conductive material 155 is disposed on both the hot side 77 and the cold side 76 of the thermoelectric modules 141 to promote good thermal coupling. Preferably, the conductive material 155 is a thermal grease.

In a preferred embodiment, one or more thermally conductive spacer blocks 156 are placed on the cold side 76 of thermoelectric modules 141. Conductive material 155 is disposed between the thermoelectric modules 141 and the thermally conductive spacer blocks 156 to increase thermal conductivity. Thermally conductive spacer blocks 156 increase the separation distance between the hot side heat sink 128 and the cold side heat sink 126, reducing thermal losses which may occur from any thermal short circuiting between the hot side heat sink 128 and the cold side heat sink 126.

Cold side heat sink 126 includes a substantially rectangular base portion 148 and a plurality of fins 149 extending in a substantially orthogonal direction from the base portion 148. The plurality of fins 149 provide more surface area for better heat transfer.

As shown, cold side heat sink 126 is mounted with base portion 148 proximate to on the thermally conductive spacer blocks 156 on the cold side 76 of mounting frame 72 and with base portion 148 proximate the sealing frame 151. Cold side heat sinks 126 contact the thermally conductive spacer blocks 156. Preferably, conductive material 155 is applied between the thermally conductive spacer blocks 156 and the cold side heat sink 126 to promote thermal transfer. Preferably, cold side sink 126 also includes a plurality of through holes 150 corresponding to blind holes 145 in hot side heat sink 128. Through holes 150 are provided to attach the cold side heat sink 126 to the blind holes 145 of hot side heat sink 128 using fasteners 146. Preferably, the fasteners 146 include sealing washers. This minimizes the risk of moisture passing between the hot side 77 and the cold side 76, increasing thermal isolation and minimizing the risk of moisture reaching the thermoelectric modules 141 or electrical components 159, 160, 161 and 162 (not shown).

As shown, insulation 153—having thermally insulating properties—is disposed between the sealing frame 151 and the cold side heat sink 126 to secure the thermally conductive spacer blocks 156 and to provide increased thermal isolation between the hot side heat sink 128 and cold side heat sink 126.

Thermoelectric module wires 154 run from the thermoelectric modules 141, are secured with wiring constraints 157 and run through wire holes 152 located in sealing frame 151. Wire holes 152 are completely sealed with sealant 138 to increase thermal efficiency and to prevent moisture from reaching the thermoelectric modules 141.

The sealant 138 at various locations in the thermoelectric air conditioner helps form a moisture resistant barrier that resists the introduction of moisture during operation of the thermoelectric air conditioner 7. For example, humid moisture-laden air is drawn through the cold side heat sink 126. Once cooled, the air which may have humidity levels approaching 100% can no longer contain as much moisture as it cools, and the air borne moisture then condenses onto the various cooling system components. Unless moisture is prevented from entering the thermoelectric air conditioner 7 by thoroughly sealing the thermoelectric modules 141 this moisture may ultimately saturate various locations causing damage to the thermoelectric modules 141 by, for example, chemical degradation, electrolysis, or the like. These sealing features also minimize moisture flow between the hot side 77 and the cold side 76, which improves thermoelectric air conditioner 7 efficiency.

Additional details regarding the thermoelectric air conditioners can be found in U.S. Pat. No. 6,345,507, entitled COMPACT THERMOELECTRIC COOLING SYSTEM, issued on Feb. 12, 2002 and U.S. Pat. No. 6,499,306, COMPACT THERMOELECTRIC COOLING SYSTEM, issued on Dec. 31, 2002, the disclosures of all of which are herein incorporated by reference.

In addition, the thermoelectrically air conditioned transit case 1 may include a sealing system, such as a gasket 81, for sealing the connection between the thermoelectric air conditioner 7 and the transit case 2. Where the thermoelectric air conditioner 7 is mounted to an opening 15 in the transit case 2, the gasket 81 can be disposed between the mounting flange 73 and the transit case 2 opening 15 and can be adapted to the size of the opening 15 and mounting flange 73. Preferably, the gasket 81 is water and oil resistant neoprene. Fasteners 75, such as sealing screws (not shown), are disposed in through holes 74 to secure the mounting flange 73 to the transit case 2 opening 15. The use of a gasket 81 and sealing screws 75 provide moisture resistance between the cold side 76 and the hot side 77 (i.e., between the inside and the outside) when the thermoelectric air conditioner 7 is installed in or on the transit case 2.

The thermoelectric air conditioned transit case can also include temperature selection means and temperature sensing means for setting and monitoring a temperature in said internal cavity 14. For example, as shown in FIG. 4 the temperature selection means can include a thermostat 105 for setting a desired temperature and the temperature sensing means can include a temperature probe 106 for monitoring the temperature in the internal cavity 14 of the transit case 2. The temperature can be varied by controlling the current flow through the thermoelectric device 7.

The thermoelectric air conditioner 7 includes a power source 159. Preferably, the power source can include AC and/or DC power. For example, the thermoelectric air conditioner 7 can include a power cord 121 for plugging into a standard power receptacle. In one preferred embodiment, the power source 159 includes a DC to DC active power supply to minimize size and reduce waste heat. Preferably, the thermoelectric air conditioner 7 is designed with a programmable power control system to maximize cooling for a given design and operating conditions.

In addition, the thermoelectrically air conditioned transit case 1 can include a case power source. In this embodiment, the thermoelectric air conditioner 7 can be electrically connected (i.e., hard-wired or plugged into) to the case power supply. The transit case power supply can in turn include a plug and power cord that can be connected to an external power source (wall outlet, lighter adapter, aircraft adapter, etc.). Furthermore, the thermoelectrically air conditioned transit case 1 can include an Uninterruptible Power Supply (UPS).

With overall weight of the portable thermoelectrically air conditioned transit case 1 being a concern, it is preferred that the transit cases 2 and the thermoelectric air conditioners 7 have light-weight designs. Preferably, the cases 2 include light-weight designs that use, for example, Thermo Stamped Composite (TSC), which is glass-reinforced polypropylene, Rotomolded PE (polyethylene), injection molded ABS, Fiberglass (FRP), and/or light-weight metal (such as Aluminum) materials. It is also contemplated that other light-weight composites and hybrid materials can be used. Other suitable materials include wood, fabric, canvas, vinyl, etc.

Further, the weight of a thermoelectric air conditioner 7 can also be reduced by, for example, changing the materials of some of the components, such as changing some components to Aluminum, and also reducing the size of components. Also, the thermoelectric air conditioner 7 can include a compact design, a light-weight power supply design and lay-out to help keep the weight of the overall thermoelectrically air conditioned transit case 1 to a minimum.

Several exemplary embodiments are outlined below illustrating systems and methods for cooling the contents of a transit case and for mounting a thermoelectric air conditioner 7 to a transit case 2.

FIGS. 1-4 show an exemplary internal thermoelectric air conditioner 7 embodiment. As shown, the case has front and rear covers 20 (although cases having a single cover are also contemplated) and a metal frame 40 inside the case internal cavity 14. As shown, the frame includes a 19-inch rack-mount frame 40. The covers 20 can also be called lids, doors, etc., and can be hinged or entirely removable. The thermoelectric air conditioner 7 mounts on the end of the frame 40, concealed inside the case when in the transit mode, viewable when in the operational mode. As shown, shock mounts 93 are positioned between the frame 40 and the walls 10 of the case 2. As shown, the thermoelectric air conditioner 7 is installed through the end opening 15 of the case 2. The cold side 76 of the thermoelectric air conditioner 7 extends into an opening 42 in the frame 40 and the mounting flange 73 of the thermoelectric air conditioner 7 is connected to the frame 40. A tongue 84 and groove 85 arrangement is shown for sealing the opening 15 when the cover 20 is secured over the end opening 15 of the case 2. An adapter plate 82 is also shown for filling-in and sealing the space between the thermoelectric air conditioner 7 and the case walls 10. In this embodiment, the air conditioner 7 is totally contained within the case 2 when the cover 20 is secured to the case 2 over the end opening 15. In this configuration, not only can one not tell there is an air conditioner 7 incorporated into the case 2 when the case 2 is in the transit mode, but the air conditioner 7 is totally protected by the design of the case 2, the mounting arrangement, the shock-mounted frame 40, etc.

Figure 5:
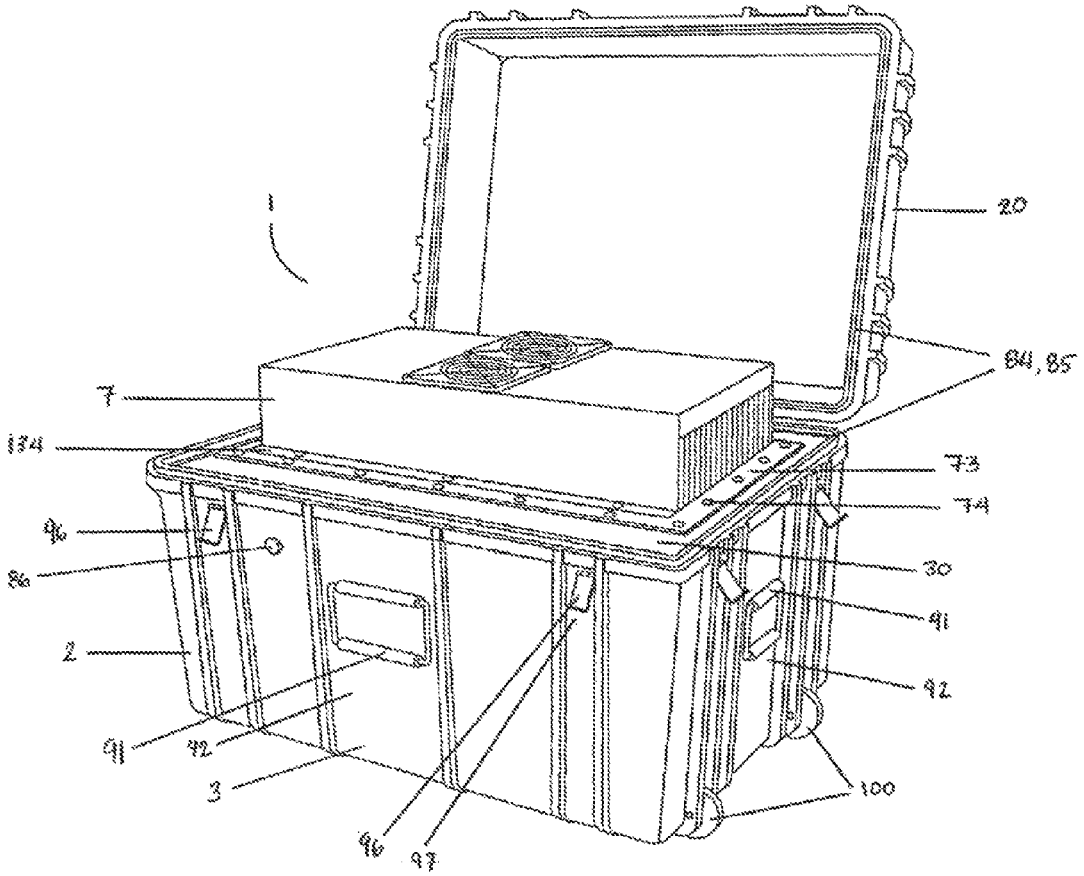
FIG. 5 shows a perspective view of another exemplary embodiment of a thermoelectrically air conditioned transit case having the thermoelectric air conditioner horizontally mounted internal to the transit case with the transit case top cover opened for clarity.
Figure 6:
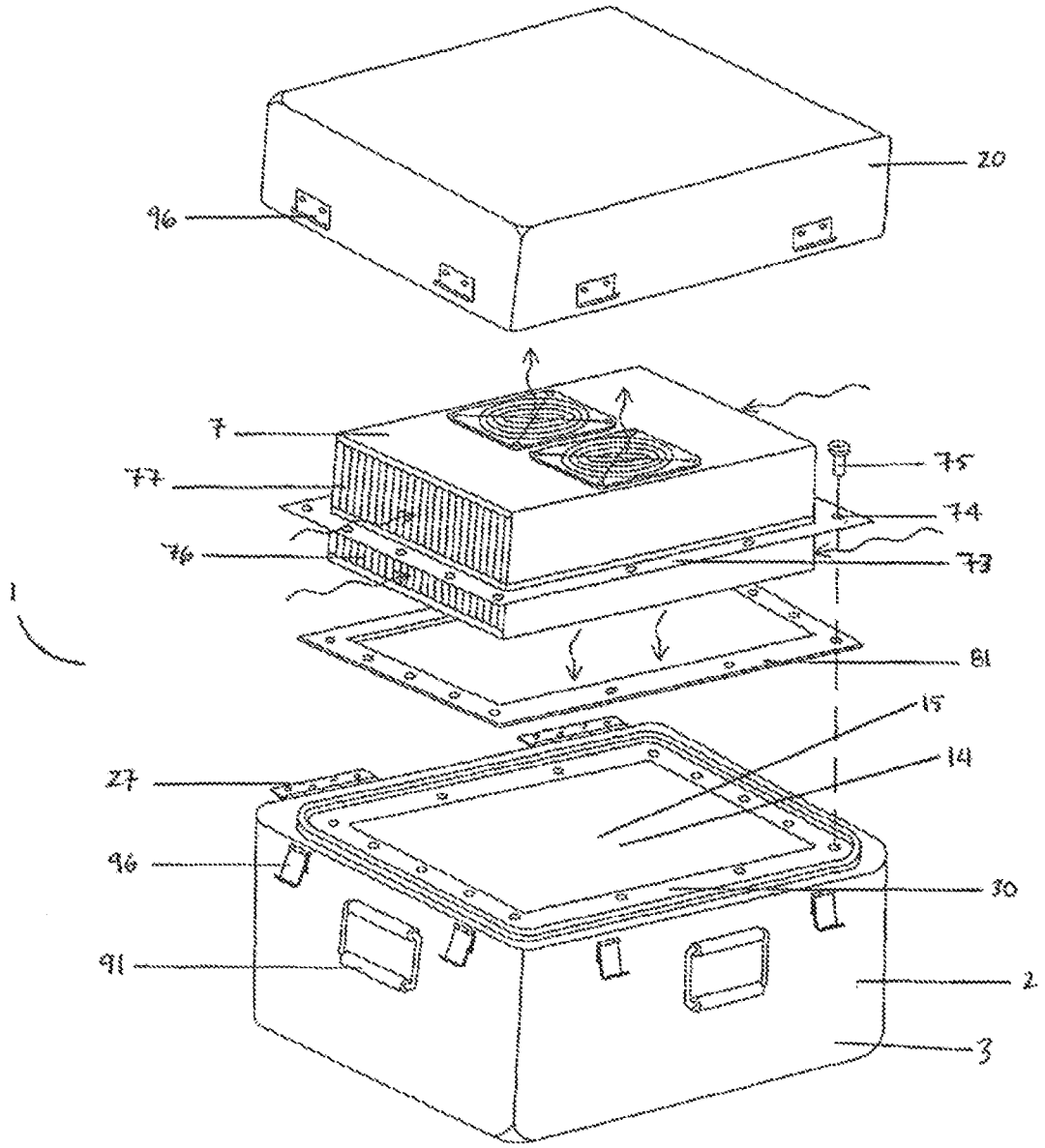
FIG. 6 is an exploded view of the exemplary thermoelectrically air conditioned transit case similar to the embodiment of FIG. 5.

FIGS. 5 and 6 show another internal thermoelectric air conditioner 7 embodiment. In the illustrated embodiments, the case includes a top cover 20 and the thermoelectric air conditioner 7 mounts inside the case 2 on a mounting plate 30 that is secured to the opening 15 of the case 2' As shown, the thermoelectric air conditioner 7 is concealed when in the transit mode and viewable when in the operational mode. In this embodiment, the top cover 20 is pivotally connected to the case 2 by hinges 27 and the thermoelectric air conditioner 7 is totally contained within the case 2 when the top cover 20 is closed. When the case 2 is in the transit mode, it is not apparent there is a thermoelectric air conditioner 7 incorporated into the case 2, and the air conditioner 7 is totally protected by the design of the case 2, the mounting arrangement, the shock-mounted frame 40, etc. As shown in FIG. 5, the case 2 can include wheels 100 to assist in the portability of the transit case 2.

FIGS. 7A-B show cases 2 with a top cover 20 and FIG. 8 shows a case 2 with an end cover 20. In each figure, the thermoelectric air conditioner 7 mounts on the top or side or end of the case 2. In the embodiments of FIGS. 7A, 7B, and 8, the thermoelectric air conditioner 7 is not concealed inside the case 2 when the case 2 is in the transit or operational mode. FIG. 7A shows a horizontal, through-mounted thermoelectric air conditioner 7 on top of the case 2, wherein at least a portion of the cold side 76 of the thermoelectric air conditioner 7 extends into the internal cavity 14 of the case 2. FIG. 7B shows a horizontal, flush-mounted thermoelectric air conditioner 7 on top of the case 2, wherein no portion of the thermoelectric air conditioner 7 extends into the internal cavity 14 of the case 2. Although not shown, the embodiments of FIGS. 7A and 7B can include a separate transit lid 25 for covering and protecting the thermoelectric air conditioner 7 during transit. The transit lid 25 can include a plastic, metal, and/or wire mesh configuration.

FIG. 8 shows a case having front and rear covers 20 where the thermoelectric air conditioner 7 mounts on the top of the case 2. FIG. 8 shows a horizontal, through-mounted thermoelectric air conditioner 7 on one side of the case 2, wherein at least a portion of the thermoelectric air conditioner 7 extends into the internal cavity 14 of the case 2. The thermoelectric air conditioner 7 is not concealed inside when the case 2 is in the transit or operational mode. Similar to the embodiments of FIGS. 7A-7B, the thermoelectric air conditioner 7 of FIG. 8 may be flush-mounted and/or through-mounted. Although not shown, the embodiment of FIG. 8 can include a separate transit lid 25 for covering and protecting the thermoelectric air conditioner 7 during transit. Also, the thermoelectric air conditioner in any of the flush-mounted and/or through-mounted embodiments could be mounted vertically at one side or end of the case 2.

Thermoelectric air conditioner 7 may also be removably mounted in or on the transit case 2 although this is more preferred for embodiments wherein the thermoelectric air conditioner 7 is externally mounted. In the embodiments of FIGS. 9A and 9B, the thermoelectric air conditioner 7 is removably mounted to the mounting plate 30 of the transit case 2. As shown in FIG. 9A, the thermoelectric air conditioner 7 is not concealed inside the case 2 when the case 2 is in the operational mode. But during transit the thermoelectric air conditioner 7 can be removed and can be stowed within the transit case 2 and thus can be concealed inside the case 2 when the case 2 is in the transit mode, as shown in FIG. 9B.

Alternatively, as shown in FIGS. 1A-10D the thermoelectric air conditioner can be shipped and protected in a separate case 2*b*. Once on-site the thermoelectric air conditioner can be removed from its shipping case 2*b* (secondary case 2*b*) and connected to the transit case 2*a* housing the temperature sensitive equipment 5 (primary case 2*a*) and placed in operation.

Figure 11:
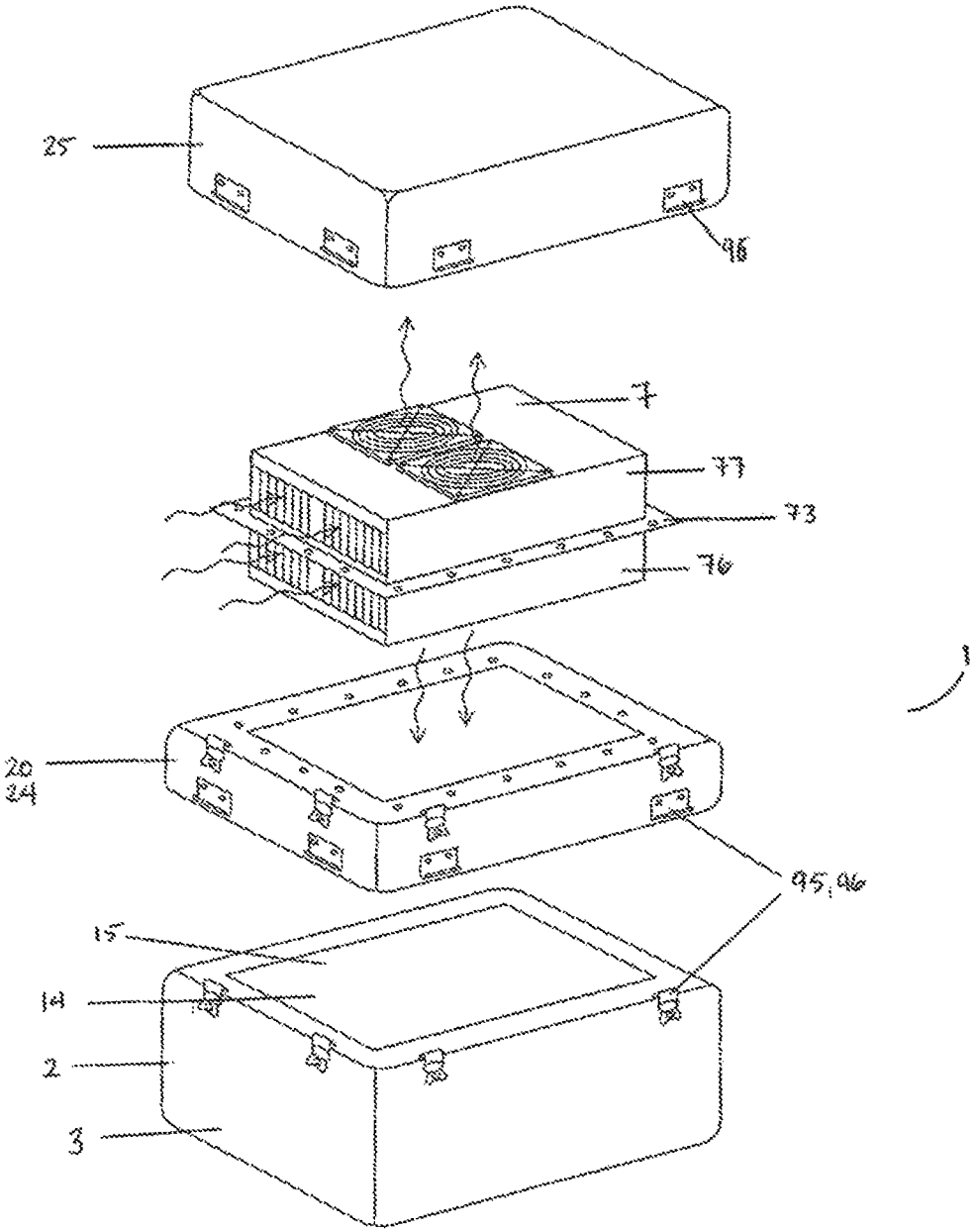
FIG. 11 is a perspective view of another exemplary embodiment of a thermoelectric air conditioned transit case having a protective, secondary lid for covering and protecting the thermoelectric air conditioner during transit.

FIG. 11 shows an alternate embodiment of the externally mounted thermoelectric air conditioner 7 further comprising a separate, secondary cover 25 for containing and protecting the thermoelectric air conditioner during transit. Once on-site, this secondary cover 25 can be removed exposing the thermoelectric air conditioner 7 for operation. This embodiment shows a case having a top cover 20 and the thermoelectric air conditioner 7 mounted on the top of the case 2, but is also applicable for cases 2 having an end cover 20 and the thermoelectric air conditioner 7 mounted on the end of the case 2. In this embodiment, the thermoelectric air conditioner 7 is concealed inside the secondary cover 25 when the case 2 is in the transit mode.

FIGS. 12A-12B and 13A-13B illustrate yet other embodiments wherein the thermoelectric air conditioner 7 is mounted in an extender piece 37 (FIGS. 12A-12B) and/or a secondary case 2*b* that is separate from the primary case 2*a* housing the equipment 5 to be protected (FIGS. 13A-13B). Preferably, the extender piece 37 and/or secondary case 2*b* include removable covers/lids/panels 25 on corresponding mating wall (e.g., top/bottom, end/end, side/side) as the mating wall of the primary case 2*a*, which is includes a removable cover 20*a*.

This allows, for example in the case of an embodiment having a secondary case, the two cases 2*a*,2*b* to be connected such that the thermoelectric air conditioner 7 in the secondary case 2*b* is in thermal communication with the internal cavity 14*a* of the primary case 2*a* in order to control the temperature of the internal cavity 14*a* of the primary case 2*a*. The removable cover/lid/panel 20*b* on the secondary case 2*b* (i.e., the case housing the thermoelectric air conditioner 7) covers and protects the thermoelectric air conditioner 7 during transit. The removable cover/lid/panel 25 on the primary case 2*a* (i.e., the case housing the equipment 5) covers and protects the equipment 5 during transit.

During operation, the two removable covers/lids/panels 25 are removed and the primary and secondary cases 2*a*, 2*b* are connected to one another. The openings 15*a*, 15*b* in the cases 2*a*, 2*b* wherein the covers/lids/panels 25 were removed allows the thermoelectric air conditioner 7 to be in thermal communication with the internal cavity 14*a* of the primary case 2*a*. Alternatively, as shown in FIGS. 13A and 13B air passageways can be formed between the cold side 76 of the thermoelectric air conditioner 7 in the secondary case 2*b* and the internal cavity 14*a* of the primary case 2*a* to help facilitate air flow between the thermoelectric air conditioner 7 and the internal cavity 14*a*. Also, the primary 2*a* and secondary 2*b* cases can be connected end-to-end, as shown in FIGS. 12A and 12B, and/or one on top of another, as shown in FIGS. 13A and 13B.

In still another embodiment, a standard "vertical" mounting orientation of an exemplary thermoelectric air conditioner 7 provides for the long side of the mounting flange 73 on the thermoelectric air conditioner 7 to be in the vertical direction. In this type of arrangement, the thermoelectric air conditioner 7 can be rotated approximately 90 degrees so that it would match with the dimensional constraints of the transit case 2.

Figure 19:
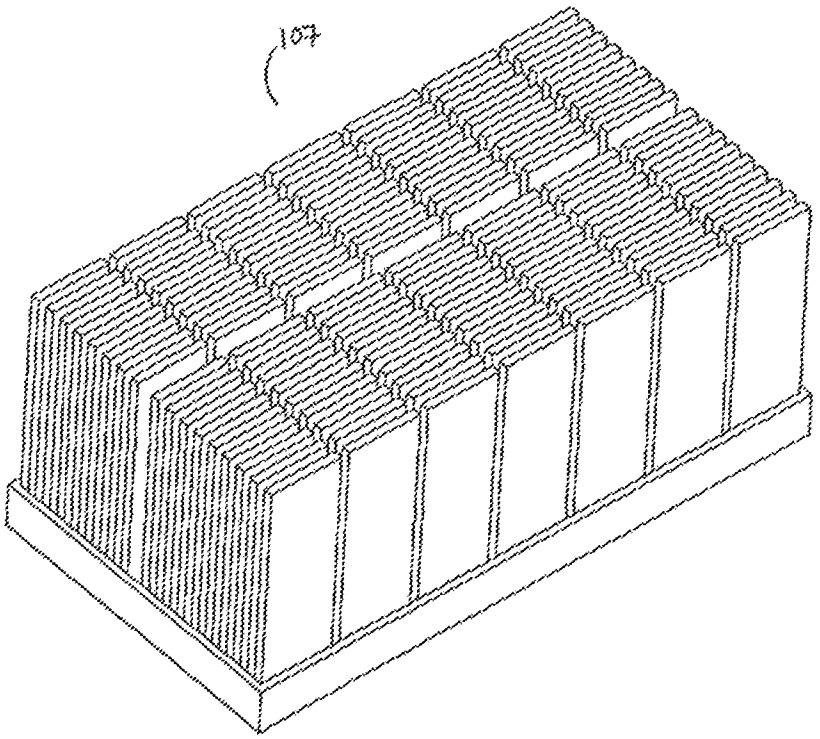
FIG. 19 shows an exemplary heat sink with slotted fins for use with the thermoelectric air conditioner.
Figure 20A:
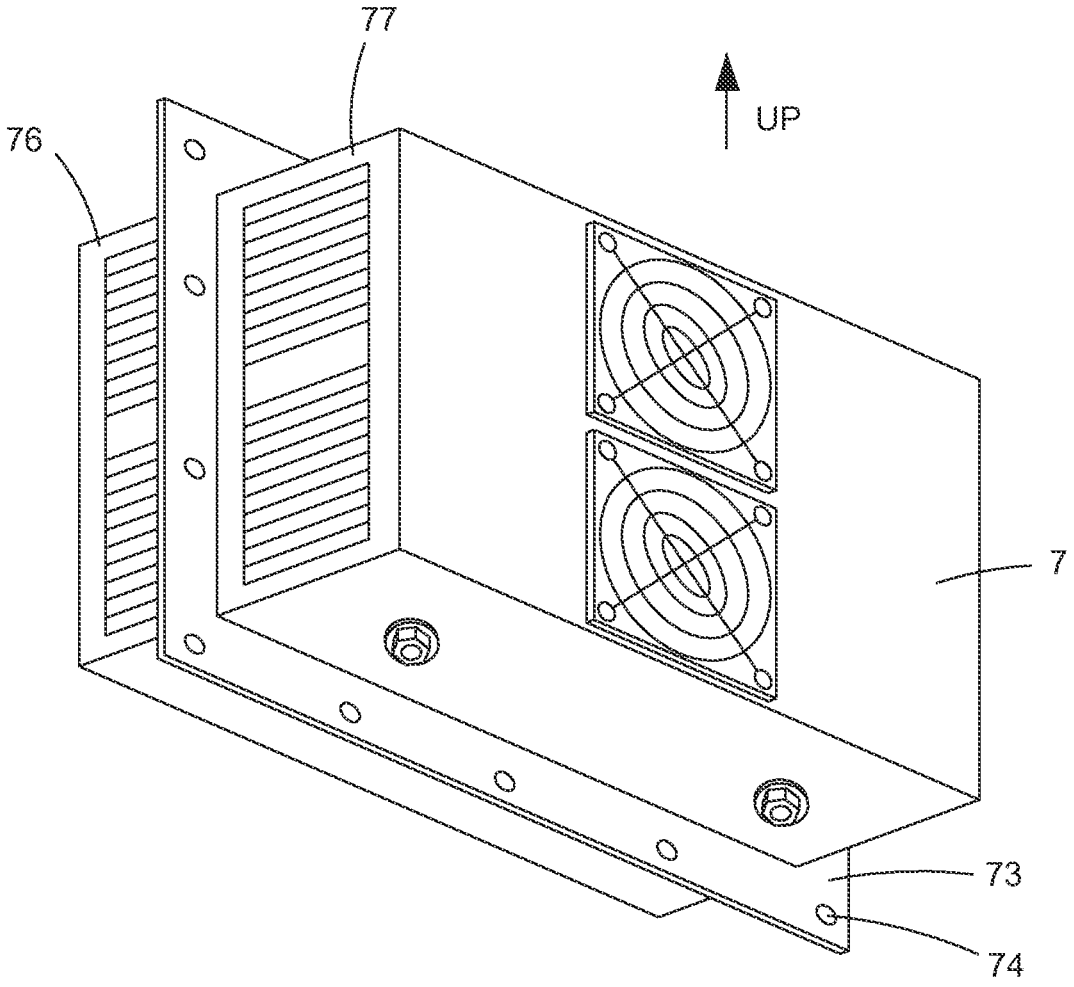
FIG. 20*a* shows an exemplary "cold side" cover of the thermoelectric air conditioner having a built-in condensate drip pan and FIG. 20*b* shows another exemplary condensate drip pan.
Figure 20B:
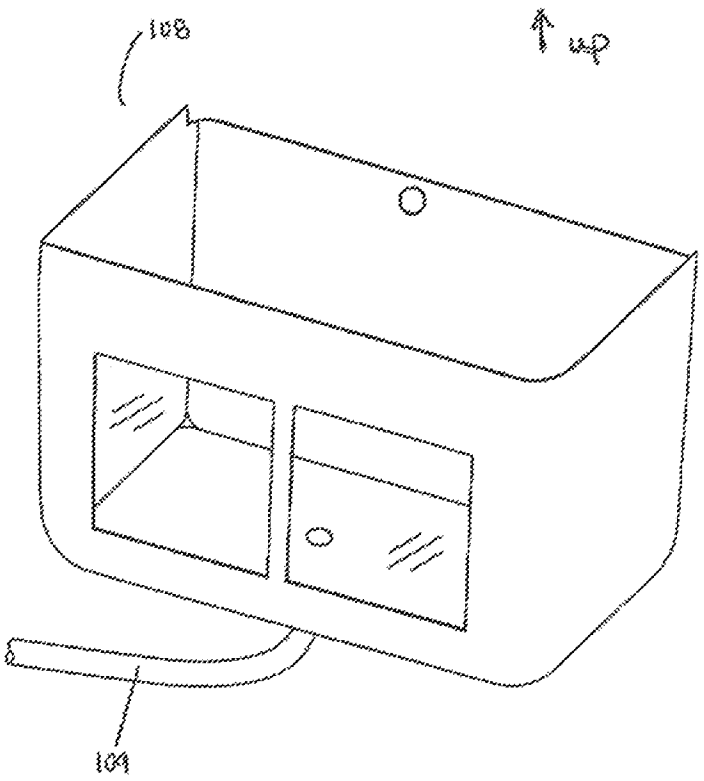

This arrangement requires features that deal with condensate collection issues. Condensate collection can be addressed through the use of one or more of the following features: (1) slotted heat sink fins 107 which allow condensate to be drawn down by gravity (see FIG. 19); (2) a modified "cold side" cover 110 which includes a built-in and/or separate condensate drip pan 108 at the bottom (see FIGS. 20*a* and 20*b*, respectively); (3) desiccant containers (not shown) that can be mounted within the transit case 2 to aid in absorbing moisture. The desiccant can include a feature to indicate when it is expired or used up. For example, the desiccant can change color when it requires renewal/replenishment. As shown in FIG. 20*b*, the condensate drip pan 108 can also include a hose 109 for leading any condensation away from the thermoelectric air conditioner 7.

Figure 21A:
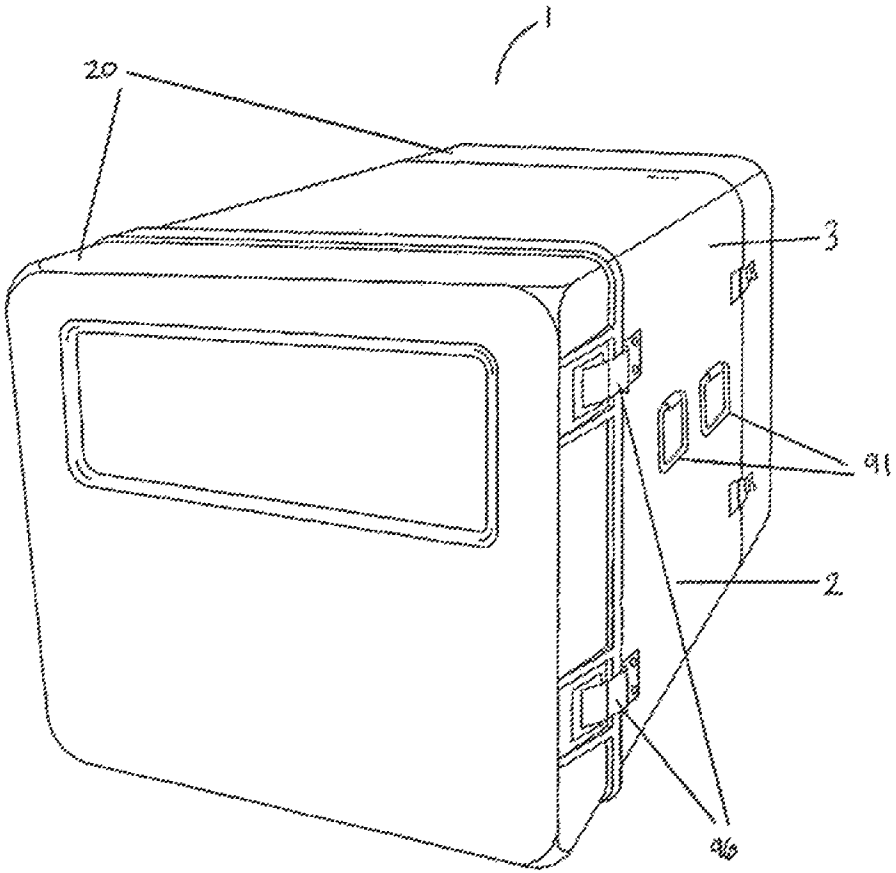
FIGS. 21A-21F show features of another exemplary thermoelectrically air conditioned transit case.
Figure 21B:
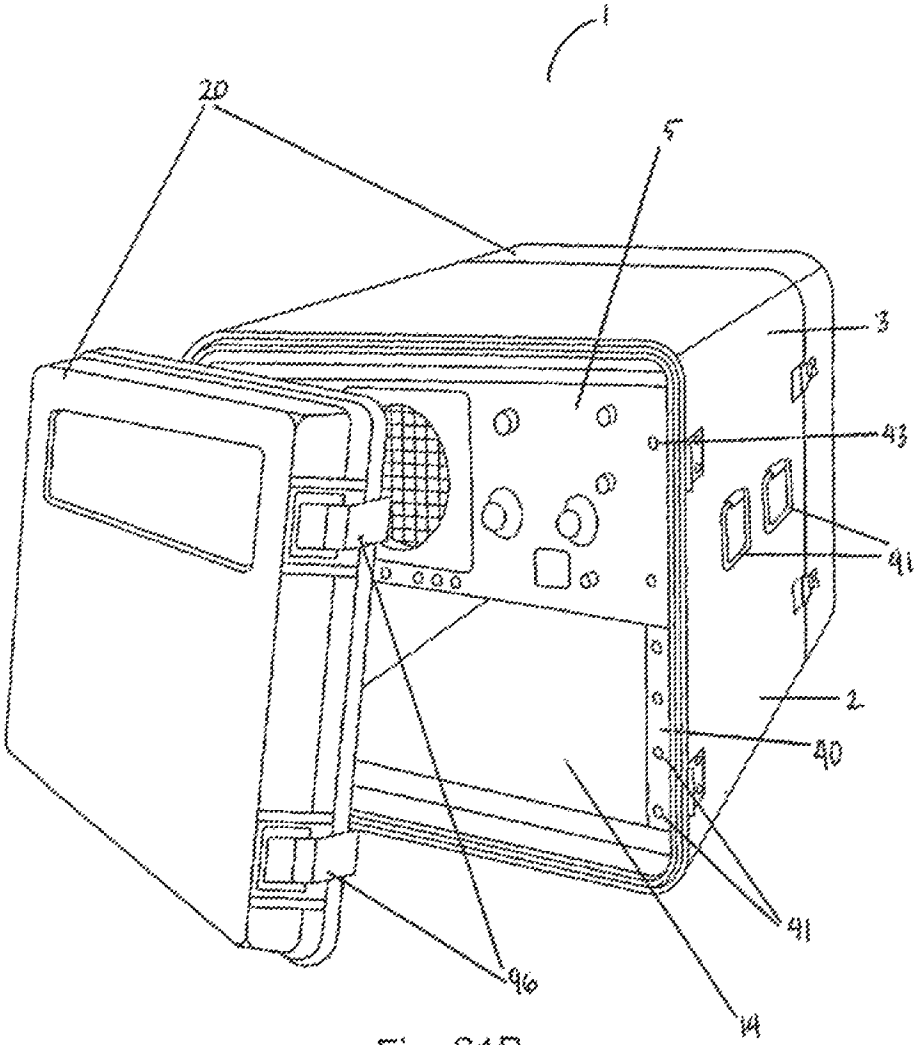
Figure 21C:
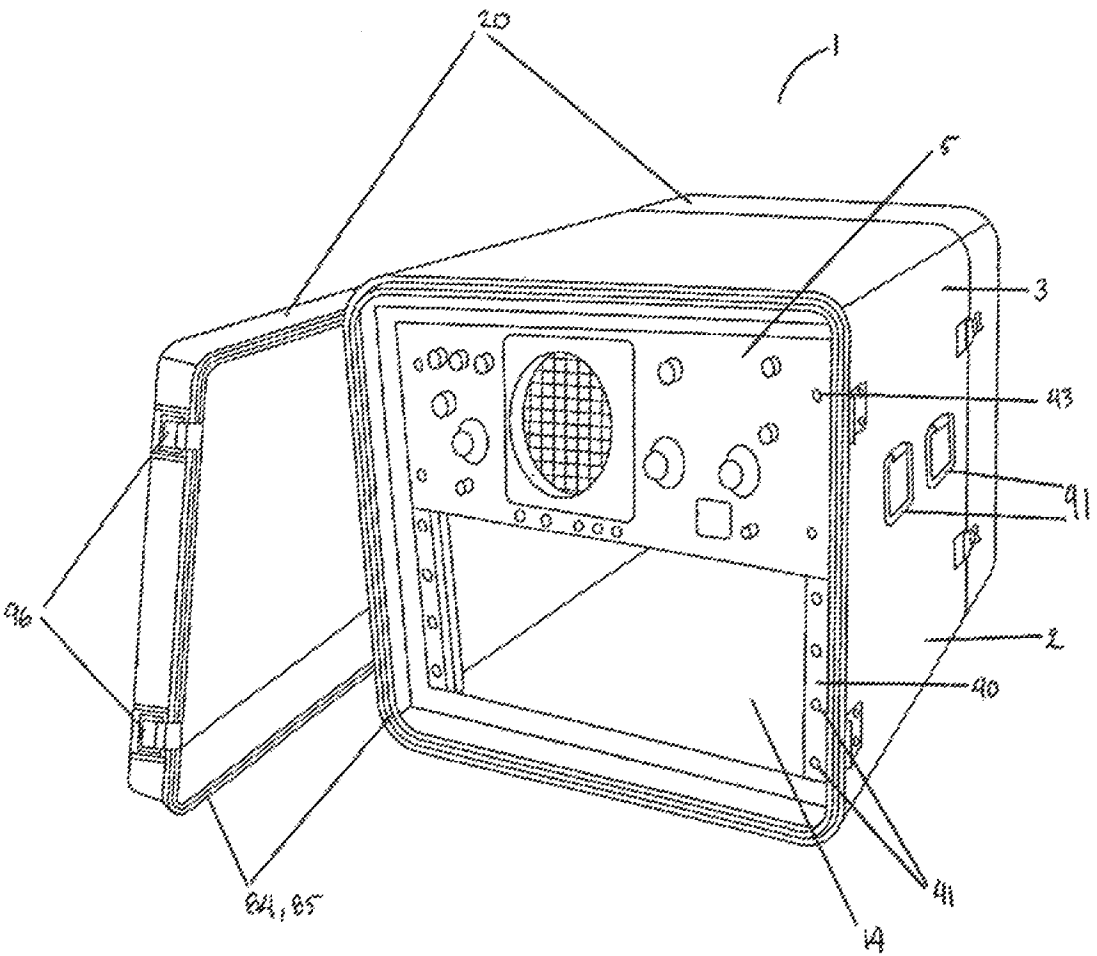

FIGS. 21A-21F shows several views of one exemplary thermoelectrically air conditioned transit case 1. FIG. 21A shows a transit case 2 with front and rear covers 20 in place. As shown, two (of four) handles 91 are visible. The front and rear covers 20 are secured to the case 2 housing by latches 96.

FIG. 21B is a front view showing the front cover 20 partially removed. Rack rails 45, such as 19-inch rack rails, can be used for mounting both the equipment 5 as well as the thermoelectric air conditioner 7. For example, a 19-inch oscilloscope is shown in FIG. 21B. Shock mounts 93 are disposed between the case walls 10 and the rack rails 45. Other equipment and/or an adapter plate (not shown) may be connected to the rack rails below the depicted oscilloscope to fill the front opening and seal the interior space.

FIG. 21C shows the front cover 20 removed entirely. As shown, complete access to the front side of the equipment 5 is provided. As shown, a rack frame 40 has a 24-inch depth (rail to rail). Other frame sizes are also available having varying dimensions, such as, for example, between about 17 to about 30-inch depth. In this embodiment, the front cover 20 is on when the transit case 2 is being transported and can be removed and/or left in place when the thermoelectric air conditioner 7 is cooling the electronics within the case 2. An adapter plate (not shown) can be mounted below and around the equipment 5 to seal the internal cavity 14 during operation when the cover 20 is removed.

Figure 21D:
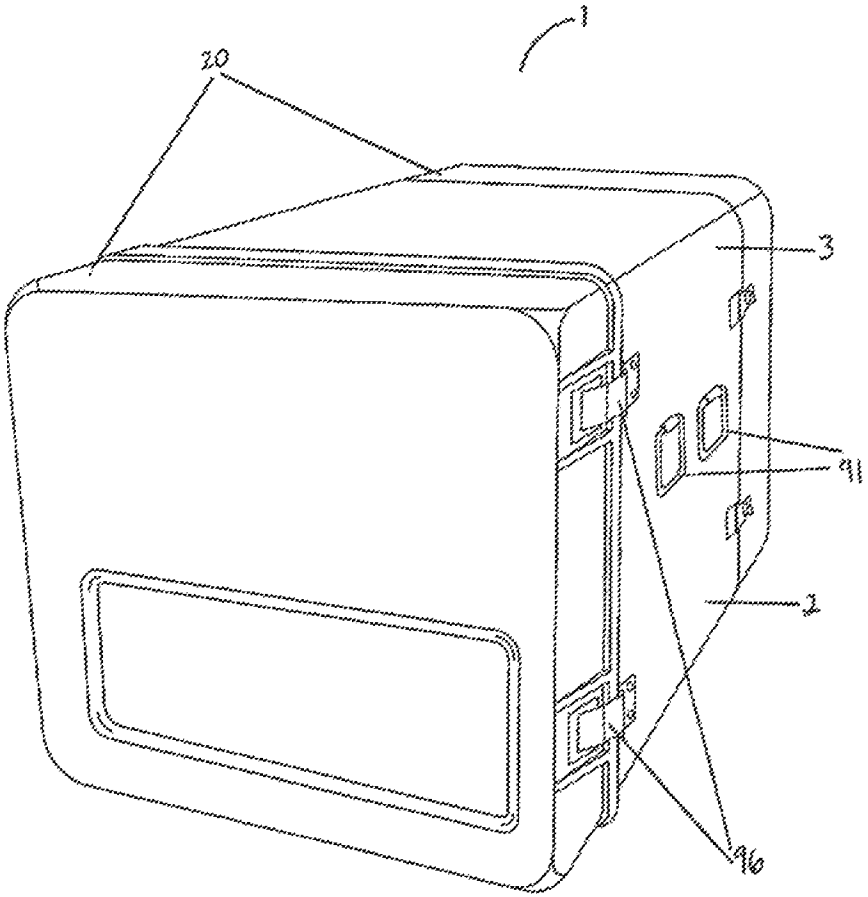

FIG. 21D is a rear view showing both covers 20 (rear and front) in place. As shown, the thermoelectric air conditioner 7 is completely concealed and contained within the case 2.

Figure 21E:
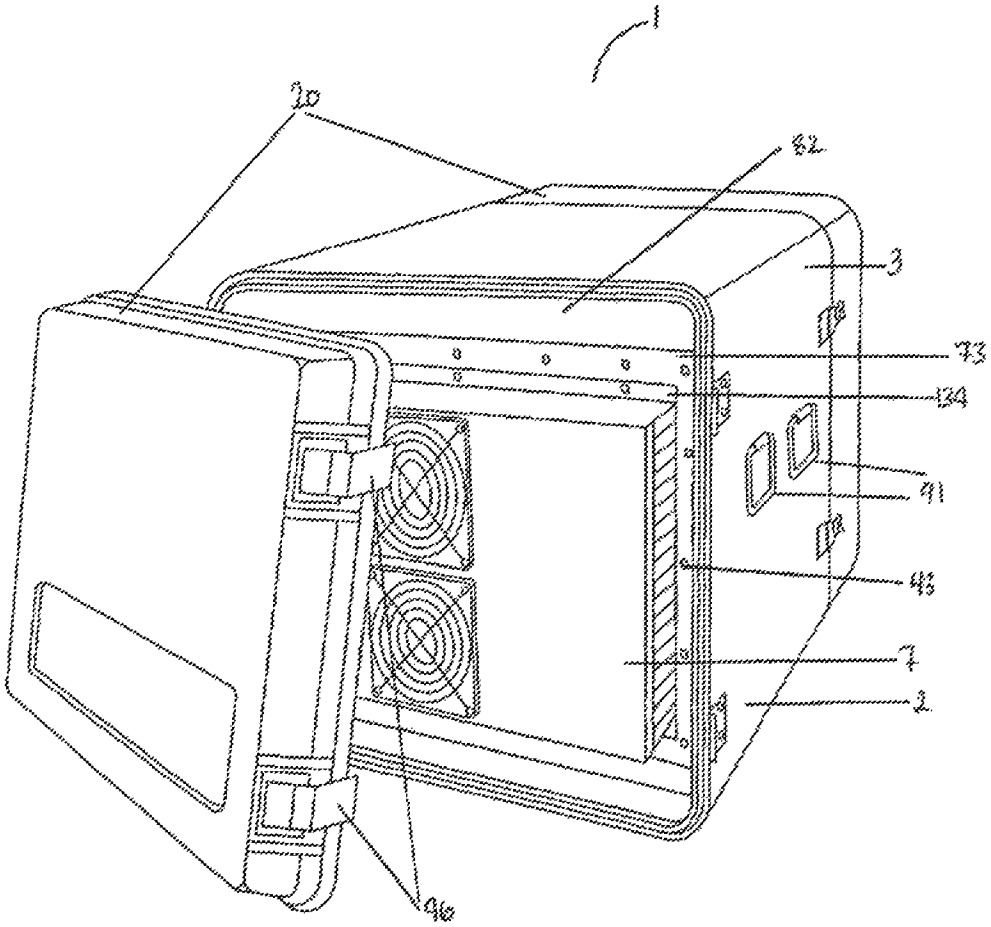

FIG. 21E shows the rear cover 20 partially removed. Preferably, the rear cover 20 is on when the transit case is being transported and off when the thermoelectric air conditioner 7 is cooling the electronics within the case 2. The thermoelectric air conditioner 7 and adapter plate 82 seal the interior cavity 14 from the outside environment.

Figure 21F:
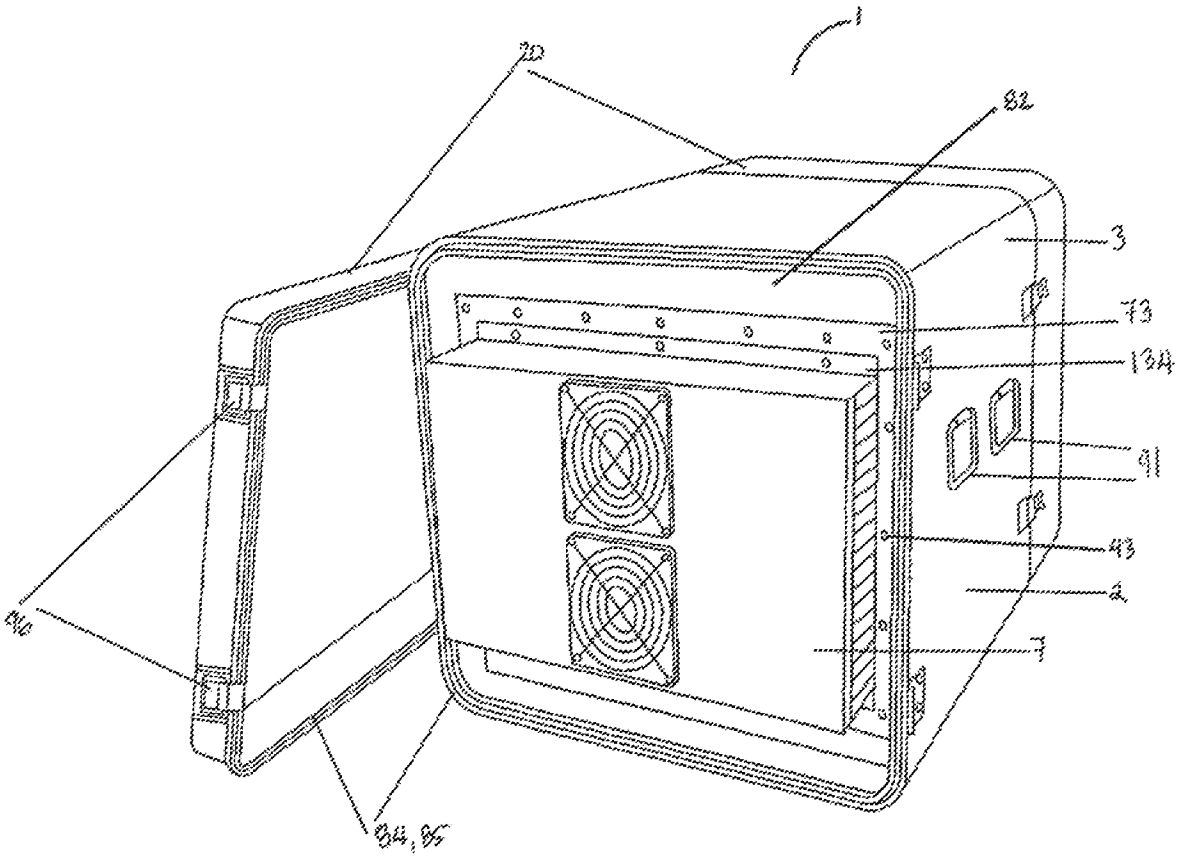

FIG. 21F shows the rear cover 20 removed entirely. Rack rails 45, such as the same 19-inch rack rails used to hold the equipment 5, can be used to mount the thermoelectric air conditioner 7 in a special orientation, with special light-weight (e.g., Aluminum) components, a special (AC and/or DC) power arrangement, and a special light-weight adapter plate 82/gasket 81 assembly to seal out contaminants. Power cables 121 can exit through a connector (not shown) positioned on the adapter plate 82.

While systems and methods have been described and illustrated with reference to specific embodiments, those skilled in the art will recognize that modification and variations may be made without departing from the principles described above and set forth in the following claims. Accordingly, reference should be made to the following claims as describing the scope of disclosed embodiments.

What is claimed is:

1. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner in thermal communication with said internal cavity for controlling a temperature within said internal cavity;

a cover for selectively covering and uncovering said thermoelectric air conditioner, wherein said cover covers said thermoelectric air conditioner when said cover is in a closed position during transit; and an extender piece disposed between said housing and said thermoelectric air conditioner, wherein said thermoelectric air conditioner is flush-mounted above said at least one opening in said housing and no portion of said thermoelectric air conditioner extends into said internal cavity of said housing.

2. The thermoelectrically air conditioned transit case of claim 1, wherein said cover comprises an existing case cover of said housing, and said thermoelectric air conditioner is mounted within said housing and said case cover when said case cover is closed.

3. The thermoelectrically air conditioned transit case of claim 1, wherein said internal cavity is environmentally controlled to maintain a desired temperature and to be contaminant-tight, said thermoelectric air conditioner further comprising means for setting and maintaining a desired temperature within said internal cavity, and said transit case and said thermoelectric air conditioner further comprising a sealing system to substantially prevent introduction of contaminants into said internal cavity.

4. The thermoelectrically air conditioned transit case of claim 1, further comprising a sealing system between said hot side and said cold side of said housing, wherein said sealing system is substantially contaminant-tight.

5. The thermoelectrically air conditioned transit case of claim 1, further comprising a case handling system comprising one or more handles.

6. The thermoelectrically air conditioned transit case of claim 5, wherein said one or more handles of said case handling system are one of disposed within a recess formed in said housing or molded in said housing, such that said one or more handles are not extending beyond a surface of said housing when said one or more handles is not in use.

7. The thermoelectrically air conditioned transit case of claim 5, wherein said thermoelectrically air conditioned transit case is light-weight and portable, wherein said light weight and portable thermoelectrically air conditioned transit case meets the lift limitations of MIL-STD-1472.

8. The thermoelectrically air conditioned transit case of claim 1, further comprising a cushioning system disposed within said internal cavity of said housing between said housing and said equipment, wherein said equipment is supported by said cushioning system to absorb and dampen a shock or vibration.

9. The thermoelectrically air conditioned transit case of claim 8, wherein said cushioning system comprises foam.

10. The thermoelectrically air conditioned transit case of claim 1, further comprising a pressure relief valve that equalizes a pressure inside and outside said case.

11. The thermoelectrically air conditioned transit case of claim 1, further comprising a shock mitigating system between said case and one of said equipment or said thermoelectric air conditioner.

12. The thermoelectrically air conditioned transit case of claim 11, wherein said shock mitigating system comprises elastomer shock mounts.

13. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner mounted in or on one of said at least one opening between said hot side and said cold side, wherein said thermoelectric air conditioner is in thermal communication with said internal cavity for controlling a temperature within said internal cavity; and a cover for selectively covering and uncovering said thermoelectric air conditioner, wherein said cover covers said thermoelectric air conditioner when said cover is in a closed position during transit, and wherein said cover comprises an existing case cover of said housing, and said thermoelectric air conditioner is mounted within said housing and said case cover when said case cover is closed.

14. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner through-mounted in one of said at least one openings in said housing, wherein at least a portion of said thermoelectric air conditioner extends internal to said internal cavity of said housing and at least a portion of said thermoelectric air conditioner extends external to said housing, wherein said thermoelectric air conditioner is in thermal communication with said internal cavity for controlling a temperature within said internal cavity; and a cover for selectively covering and uncovering said thermoelectric air conditioner, wherein said cover covers said thermoelectric air conditioner when said cover is in a closed position during transit.

15. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner mounted in or on one of said at least one opening between said hot side and said cold side, wherein said thermoelectric air conditioner is in thermal communication with said internal cavity for controlling a temperature within said internal cavity; and a cover for selectively covering and uncovering said thermoelectric air conditioner, wherein said cover covers said thermoelectric air conditioner, wherein said internal cavity is environmentally controlled to maintain a desired temperature and to be contaminant-tight, said thermoelectric air conditioner further comprising means for setting and maintaining a desired temperature within said internal cavity, and said transit case and said thermoelectric air conditioner further comprising a sealing system to substantially prevent introduction of contaminants into said internal cavity.

16. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner mounted in or on one of said at least one opening between said hot side and said cold side, wherein said thermoelectric air conditioner is in thermal communication with said internal cavity for controlling a temperature within said internal cavity;

a cover for selectively covering and uncovering said thermoelectric air conditioner, wherein said cover covers said thermoelectric air conditioner; and a sealing system between said hot side and said cold side of said housing, wherein said sealing system is substantially contaminant-tight.

17. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner mounted in or on one of said at least one opening between said hot side and said cold side, wherein said thermoelectric air conditioner is in thermal communication with said internal cavity for controlling a temperature within said internal cavity;

a cover for selectively covering and uncovering said thermoelectric air conditioner, wherein said cover covers said thermoelectric air conditioner; and a case handling system comprising one or more handles;

wherein said thermoelectrically air conditioned transit case is light-weight and portable, wherein said light weight and portable thermoelectrically air conditioned transit case meets the lift limitations of MIL-STD-1472.

18. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner mounted in or on one of said at least one opening between said hot side and said cold side, wherein said thermoelectric air conditioner is in thermal communication with said internal cavity for controlling a temperature within said internal cavity;

a cover for selectively covering and uncovering said thermoelectric air conditioner, wherein said cover covers said thermoelectric air conditioner; and a pressure relief valve that equalizes a pressure inside and outside said case.

19. A thermoelectrically air conditioned transit case comprising:

a portable housing having a hot side and a cold side;

an internal cavity in said housing for storing temperature sensitive equipment;

at least one opening in said housing providing access to said internal cavity;

a thermoelectric air conditioner mounted in or on one of said at least one opening between said hot side and said cold side, wherein said thermoelectric air conditioner is in thermal communication with said internal cavity for controlling a temperature within said internal cavity;

a cover for selectively covering and uncovering said thermoelectric air conditioner, wherein said cover covers said thermoelectric air conditioner; and a shock mitigating system between said case and one of said equipment or said thermoelectric air conditioner, wherein said shock mitigating system comprises elastomer shock mounts.

* * * * *